US009909242B2

(12) United States Patent
Schneider et al.

(10) Patent No.: US 9,909,242 B2
(45) Date of Patent: Mar. 6, 2018

(54) AUTOMATIC NEEDLE PLACEMENT MACHINE AND AUTOMATIC PLACEMENT METHOD

(71) Applicant: AUTEFA SOLUTIONS GERMANY GMBH, Friedberg (DE)

(72) Inventors: Jan Schneider, Diedorf/Anhausen (DE); Rudolf Kuhn, Neusäβ (DE); Stefan Schlichter, Friedberg (DE); Joachim Binnig, Jettingen-Scheppach (DE); Guido Herzog, Rheineck (CH)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 0 days.

(21) Appl. No.: 15/034,032

(22) PCT Filed: Nov. 4, 2014

(86) PCT No.: PCT/EP2014/073708
§ 371 (c)(1),
(2) Date: May 3, 2016

(87) PCT Pub. No.: WO2015/063328
PCT Pub. Date: May 7, 2015

(65) Prior Publication Data

US 2016/0273143 A1 Sep. 22, 2016

(30) Foreign Application Priority Data

Nov. 4, 2013 (DE) ..... 20 2013 104 925 U
Dec. 30, 2013 (DE) ..... 20 2013 105 980 U

(51) Int. Cl.
*D04H 18/02* (2012.01)

(52) U.S. Cl.
CPC ..... *D04H 18/02* (2013.01)

(58) Field of Classification Search
CPC .. D04H 18/00; D04H 18/02; Y10T 29/53478; Y10T 29/49895; Y10T 29/53;
(Continued)

(56) References Cited

U.S. PATENT DOCUMENTS 1,485,413 A 3/1924 Johanson
4,122,975 A 10/1978 Lowery et al.
(Continued)

FOREIGN PATENT DOCUMENTS

DE 8329050 U1 1/1984
DE 8512596 U1 6/1985
(Continued)

*Primary Examiner* — Amy Vanatta
(74) *Attorney, Agent, or Firm* — McGlew and Tuttle, P.C.

(57) ABSTRACT

An automatic needle placement machine (1) and a placement method for needles (4) on needle boards (2) of non-woven needle machines has a holding apparatus (10) for the needle board (2), a needle removal apparatus (12) and a needle placement apparatus (13) for removing and placing needles (4) from and in receptacle openings (3) of the needle board. The holding, needle placement and needle removal apparatuses (10, 12, 13) can be moved and positioned in a linear manner and relative to each other by means of an automatic positioning apparatus (11, 16). The holding apparatus (10) for the needle board (2) has a multi-axis positioning apparatus (11), wherein the needle placement and needle removal apparatus (12, 13) are arranged in a relatively stationary manner on a frame (15) or on a machine frame (8).

20 Claims, 16 Drawing Sheets

(58) Field of Classification Search
CPC ..... B25C 1/005; B23P 19/04; B23P 19/10; B23P 19/105; B23P 19/107; B23P 19/12
USPC ..... 28/107, 115; 227/120, 124, 127, 129, 227/135
See application file for complete search history.

(56) References Cited

U.S. PATENT DOCUMENTS

| | | | | |
|---|---|---|---|---|
| 4,936,497 | A | 6/1990 | Ordelt | |
| 5,291,652 | A * | 3/1994 | Vossen | B26D 7/1818 227/128 |
| 5,509,185 | A * | 4/1996 | Petkov | B23P 19/04 29/252 |
| 6,195,855 | B1 * | 3/2001 | Feyerl | D04H 18/02 28/107 |
| 6,393,393 | B1 | 5/2002 | Finocchi | |
| 2008/0184546 | A1 * | 8/2008 | Munster | D04H 18/02 29/428 |
| 2009/0064475 | A1 * | 3/2009 | Munster | D04H 18/02 28/115 |
| 2010/0162543 | A1 * | 7/2010 | Dilo | D04H 18/00 28/115 |
| 2010/0242266 | A1 * | 9/2010 | Munster | D04H 18/00 29/700 |
| 2014/0026379 | A1 * | 1/2014 | Herzog | D04H 18/02 28/115 |

FOREIGN PATENT DOCUMENTS

| | | | |
|---|---|---|---|
| DE | 3941159 | C2 | 9/1991 |
| DE | 3201282 | C2 | 10/1991 |
| DE | 102011016755 | B3 | 10/2012 |
| EP | 1953287 | A1 | 8/2008 |
| EP | 2037030 | A1 | 3/2009 |
| EP | 2233626 | A1 | 9/2010 |
| JP | H0731895 | U | 6/1995 |
| JP | H11350328 | A | 12/1999 |
| WO | 2012139761 | A1 | 10/2012 |

* cited by examiner

AUTOMATIC NEEDLE PLACEMENT MACHINE AND AUTOMATIC PLACEMENT METHOD

CROSS REFERENCE TO RELATED APPLICATIONS

This application is a United States National Phase Application of International Application PCT/EP2014/073708 filed Nov. 4, 2014 and claims the benefit of priority under 35 U.S.C. § 119 of German Applications 20 2013 104 925.5 filed Nov. 4, 2013 and 20 2013 105 980.3 filed Dec. 30, 2013 the entire contents of which are incorporated herein by reference.

FIELD OF THE INVENTION

The present invention pertains to an automatic needle placement machine and to an automatic placement method for needle boards of needle machines, wherein the automatic needle placement machine has a holding apparatus for the needle board, a needle removal apparatus and a needle placement apparatus for removing and placing needles from and in receptacle openings of the needle board, and the holding, needle placement and needle removal apparatuses are movable linearly and relative to one another by means of an automatic positioning apparatus and can be positioned.

BACKGROUND OF THE INVENTION

An automatic needle placement machine in the form of an articulated-arm robot, which performs the placement and removal of needles on and from a needle board of a nonwoven needle machine, is known from WO 2012/139761 A, wherein the robot combines a needle removal apparatus and a needle placement apparatus with one another and combines the functions thereof in itself.

Further, it is known that needle boards can be fitted with needles manually, wherein a placing tool is used, which receives a larger number of pre-aligned needles and is handled by a human operator.

SUMMARY OF THE INVENTION

An object of the present invention is to provide an improved automatic needle placement device and technique.

The automatic needle placement technique according to the invention, especially the automatic needle placement machine and the automatic needle placement method, offer advantages in terms of efficiency, precision and the efficiency of needle placement. The needle placement includes both the needle removal and the needle placement as well as a combined needle removal and needle placement on a needle board.

The automatic and linearly movable positioning technique according to the invention has the advantage of easy controllability, short cycle times and the possibility of a modular expansion of the automatic needle placement machine. The needle board with its holding apparatus is preferably moved by means of a biaxial positioning apparatus relative to a needle removal and needle placement apparatus, which is stationary relative to it. This is advantageous for an accurate and rapid positioning as well as a relatively simple and cost-effective control software. However, other kinematic variants are possible as well. The variants have, in addition, the advantage of good accessibility to the automatic needle placement machine, and it is possible, in particular, to move out the needle board laterally and to change it.

The needle placement and needle removal apparatus may be arranged separately and on both sides of the needle board or the holding apparatus thereof. With the preferred kinematic variant, these apparatuses possibly perform only feed motions with their respective needle placement or needle removal tools to the needle board.

The needle placement technique provides for a detection device for the needle quality, which may have different designs. In a preferred embodiment, the detection may be combined with needle removal, especially with the at least partial ejection of a needle. Time can be saved as a result compared to a separate detection, and the placement process can be expedited. This embodiment is of independent inventive significance and may also be employed in other needle placement techniques and kinematics already known from the state of the art mentioned in the introduction.

A separate detection is also possible in other variants, e.g., with an optical inspection by a camera, a photoelectric cell or other similar contactless or contacting sensor systems.

The needle placement technique may comprise the utilization of the removed needles, which may have different variants, especially a disposal and/or further use of the needles depending on their detected quality. Aside from the replacement of damaged and worn needles and of needles that are unfit for use for other reasons, this also makes it possible to specifically transfer needles to other areas of the needle board. Needle wear can be made uniform hereby. The loads on the needles and wear are different in different areas of the needle board; in particular, there is an increase in the direction in which the nonwoven runs on the needle machine. Due to the wear being made uniform, the service life of the needles is increased and efficiency is improved.

The needle placement technique makes it, in addition, possible to specifically identify and qualify the individual needles and to assign a data set for localizing and describing the needle. Moreover, a needle flow control can be achieved with a control and with a corresponding program. In addition, causes of wear or damage of the needles, in particular, which are clustered, for example, in some areas of the needle board, can be easier and better understood and eliminated. The quality of the needle board and of the needle process carried out thereby in the textile needle machine can be improved hereby. Any defects occurring on the needled nonwoven can be traced back to certain needles and causes of defects and eliminated in a specific manner. This is accompanied by an especially good and demonstrable quality assurance. This checking and utilization of needles is of independent inventive significance and may also be employed in other needle placement techniques and kinematics, especially those already known from the state of the art mentioned in the introduction.

There are various possibilities for the design embodiment of the needle removal and needle placement apparatuses. The needle placement technique makes it possible to receive an individual needle, which can then accurately be inserted into the receptacle opening of the needle board, in a specific manner, to align it by a subsequent rotary and/or translatory motion, and then to insert it in this alignment accurately into the receptacle opening of the needle board. These process steps may be carried out one after another and at separate devices of the needle placement tool. This is advantageous for the precision, reliability of operation and cycle time. It is favorable for a gentle treatment of the needles to perform the alignment of the needle before insertion into the needle board. The needle placement tool has a corresponding design for this. This needle placement technique is likewise of independent inventive significance and may also be used in already known needle placement techniques and kinematics, especially those known from the state of the art mentioned in the introduction.

The transfer and the further transportation of the received needle between the devices of the needle placement tool may be effected by means of transport devices and grippers. The grippers may be correspondingly adapted to the requirements of the process.

The alignment of the received needle may be carried out in a gripped position at a gripper. This is advantageous for the alignment operation and precision. A positive-locking circumferential holding of the needle, which permits rotation and/or displacement of the needle, is favorable for the alignment. Each needle may be aligned individually, and it may be brought, e.g., into any desired rotation position with its crank.

The placement of a needle may take place in a plurality of steps, the needle being inserted into a receptacle opening at the needle board while maintaining its alignment set previously, and is then pushed into its end position. To maintain the needle alignment, the gripper or grippers may act in a non-positive manner and hold the needle in, e.g., a clamping connection.

The separation of the needles may take place at a separating apparatus, which may be part of the needle placement tool or may be associated herewith. It may also be a part of a possibly more complex feeding device. The separation is preferably performed with a lifting post from a needle container. This has advantages for precision and safety and for the reduction of the design effort and costs as well as for the possibilities of automation.

The separating apparatus can ensure the especially rapid and accurate separation of needles from a random stock. The design effort as well as the effort needed for control for the separating apparatus are low. On the other hand, the separation operates very fast and reliably. The needle placement apparatus can grip a separated needle, which is accurately aligned and positioned in terms of translatory and/or rotary motions, and place it in any desired rotation position in the receptacle opening of the needle board. The alignment and prepositioning of the separated needle may be carried out, as an alternative, later with the needle already gripped.

The feeding apparatus for the needles may also have a magazine, whose functions may possibly be adaptable. It may be used both for feeding new needles and for the temporary intermediate deposition of removed needles for further use later. Defective needles may be thrown off.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 15 is a perspective view showing a variant of the needle placement apparatus in;

DESCRIPTION OF THE PREFERRED EMBODIMENTS

Figure 1:
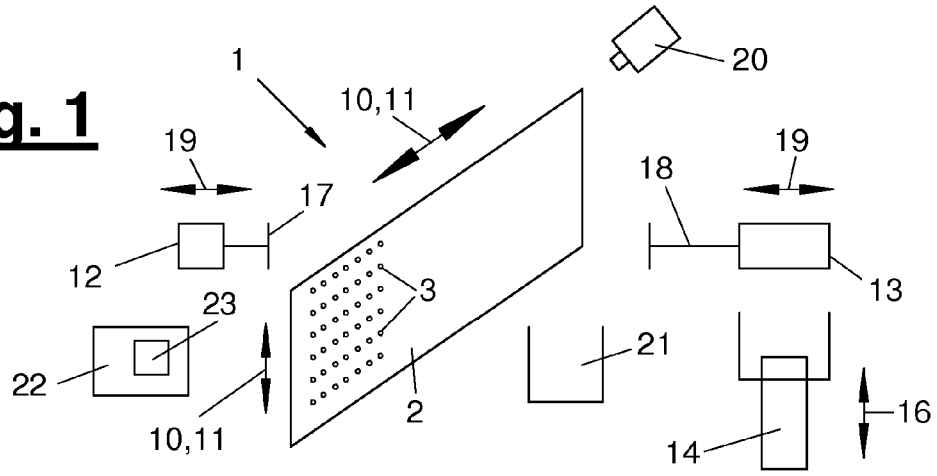
FIG. 1 is a schematic view showing one of different kinematic variants of an automatic needle placement machine for a relative linear motion and positioning of a holding apparatus for a needle board and of a needle placement and needle removal apparatus.

Referring to the drawings, the present invention pertains to an automatic needle placement machine (1) for needles (4) on needle boards (2) of nonwoven needle machines as well as to a needle placement method. Said needle placement includes the needle removal or the needle placement or a combination of both. The present invention pertains, furthermore, to a needle placement apparatus (13) and to a needle placement method for placing needles (4) on needle boards (2) of nonwoven needle machines. Said needle placement includes the removal of partially pushed-out needles (4) from the needle board (2).

Figure 2:
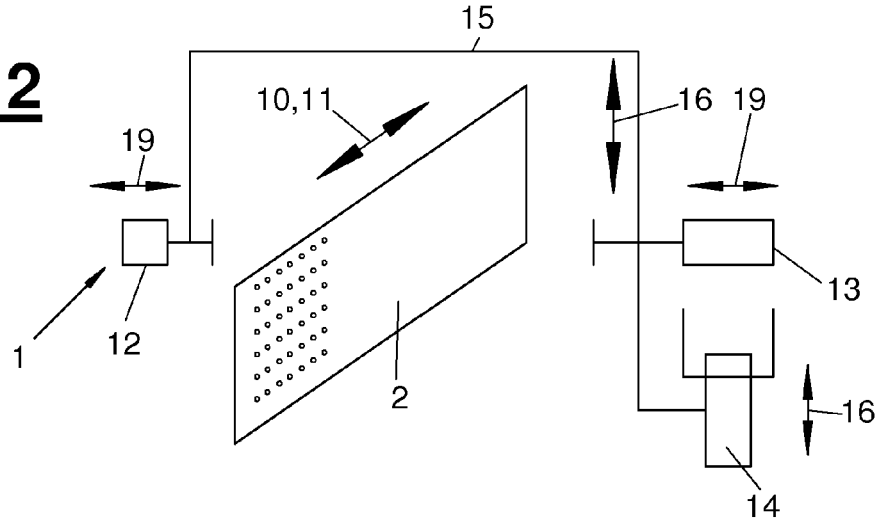
FIG. 2 is a schematic view showing another of different kinematic variants of an automatic needle placement machine for a relative linear motion and positioning of a holding apparatus for a needle board and of a needle placement and needle removal apparatus.
Figure 3:
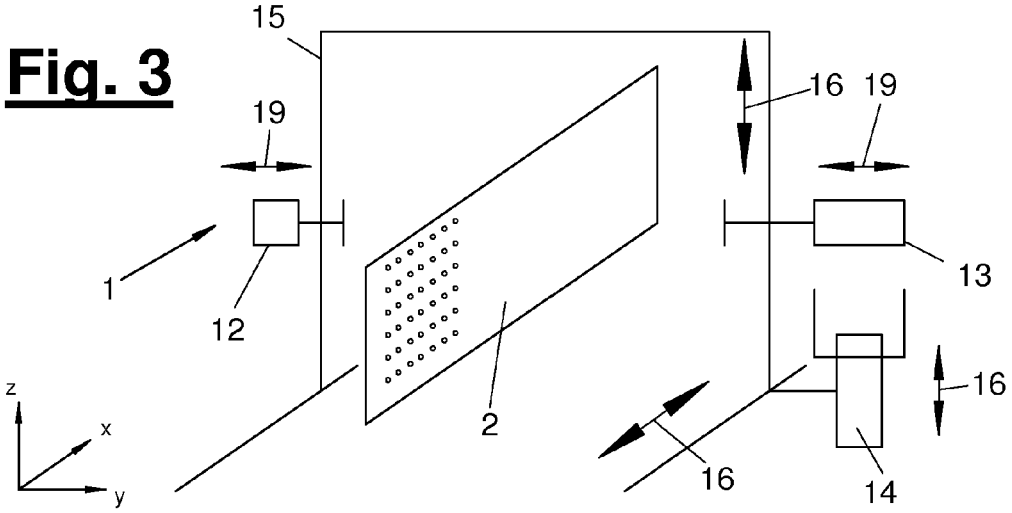
FIG. 3 is a schematic view showing another of different kinematic variants of an automatic needle placement machine for a relative linear motion and positioning of a holding apparatus for a needle board and of a needle placement and needle removal apparatus.

FIGS. 1 through 3 show schematic diagrams of the automatic needle placement machine (1) and components thereof with different kinematics. A preferred embodiment is shown in FIG. 1.

The automatic needle placement machine (1) has a schematically indicated holding apparatus (10), e.g., a clamping frame, for one or more needle boards (2), which are equipped with a plurality of receptacle openings (3) for needles (4) (not shown), wherein the openings (3) are preferably distributed in a grid. The needle board (2) receives, e.g., an upright layer.

The automatic needle placement machine (1) has, furthermore, a needle removal apparatus (12) and a needle placement apparatus (13). Needles (4) are placed in receptacle openings (3) with the needle placement apparatus (13). The placement may take place in a plurality of steps, e.g., a receiving, alignment, insertion and subsequent pushing in of the needle (4).

The needle removal apparatus (12) is used to remove needles (4) from the receptacle openings (3). The needle removal apparatus (12) may be used especially to partially push needles (4) out of the receptacle openings (3). The pushed-out needles (4) can also be gripped with the needle placement apparatus (13), removed from the receptacle openings (3) and removed or discharged.

The holding apparatus (10) as well as the needle placement and needle removal apparatus (12, 13) can be moved in a linear manner and relative to one another by means of an automatic single-axis or multi-axis positioning apparatus (11, 16) and positioned. The needle removal and needle placement apparatuses (12, 13) come each into a working position at the needle board (2) and at the receptacle opening (3) being acted on.

The automatic needle placement machine (1) may have, furthermore, a feeding apparatus (14) for needles (4), which optionally also has a positioning apparatus (16). Further, the automatic needle placement machine (1) may have a detection apparatus (20) for the needle quality and a utilization apparatus (21) for removed needles (4).

The automatic needle placement machine (1) has a control (22), which is connected to the aforementioned components of the automatic needle placement machine (1), especially the positioning apparatuses (11, 16), the needle removal and needle placement apparatus (12, 13) and the detection apparatus (20).

The needle removal and needle placement apparatuses (12, 13) are arranged on opposite sides of the needle board (2) and are preferably located opposite each other aligned with the axis of the receptacle openings (3). The needle removal and needle placement apparatuses (12, 13) have a tool (17, 18) each with an advancing apparatus (19) for advancing to the needle board (2). They may, furthermore, cooperate with their tools (17, 18) during the removal of needles (4). An interaction may also take place, as an alternative or in addition, during the placement of needles (4).

The automatic positioning apparatus (11, 16) has at least one linear positioning axis with a controllable drive and with a measuring apparatus for the displacement and/or the position. At least one reference point may be present for referencing or calibration at one of the apparatuses (10, 12, 13) moving relative to one another with a corresponding detection apparatus. A reference is also established hereby to the position of the receptacle openings (3). The working sites can be accurately reached with the positioning apparatus (11, 16) in the opening grid with the tool (17, 18).

In the preferred variant according to FIG. 1, the needle board (2) is moved with linear space axes (x, z) horizontally and vertically relative to the needle placement and needle removal apparatuses (13, 12), which are preferably stationary or relatively stationary in relation to the needle board (2). The holding apparatus (10) is connected for this to a multi-axis positioning apparatus (11), which has, e.g., a cross slide with controllable drives and with measuring apparatuses along with a connection to the control (22).

FIG. 2 shows another kinematic variant, in which the components shown and explained in FIG. 1 are otherwise identical, even though they are not all shown for clarity's sake. The needle removal and needle placement apparatuses (12, 13) are rigidly connected to one another or coupled with one another in another manner in FIG. 2 via a bow-shaped frame (15) or a frame (15) closed in a ring-shaped manner. For example, a one-axis vertical positioning apparatus (16) of the type mentioned acts on the frame (15). The needle board (2) is moved, in turn, in the horizontal direction by means of a positioning apparatus (11). The feeding apparatus (14) may likewise be connected to the frame (15).

FIG. 3 shows a variant with a relatively stationary needle board (2) and with a gantry-like frame (15), which connects the needle removal and needle placement apparatuses (12, 13) as well as the feeding apparatus (14) to one another and which has a biaxial positioning apparatus (16) for a biaxial linear movement in the horizontal direction and in the vertical direction.

Aside from the three kinematic variants shown, there are additional alternatives and mixed forms. The preferred embodiment according to FIG. 1 with a needle board (2) moved along two axes is used in the exemplary embodiments described below.

The automatic needle placement machine (1) has the aforementioned detection apparatus (20) for the needle quality. It is checked here whether the needles (4) are damaged or worn or even missing. Damaged needles (4) may, e.g., be broken off or bent. In addition, a distinction can be made in his connection whether the defect or wear is great enough for the needles to have become unfit for use or whether tolerable defects or wear phenomena are present, which allow further use.

The detection apparatus (20) may have different designs. It may have, on the one hand, an optical inspection apparatus for the needle quality. This may be, e.g., a camera system, which performs the measurement of the needles (4), especially of the front tip and of the adjoining shank area (5). Broken-off needle areas, bends and other defects can be detected hereby. Another possibility of inspection or measurement is offered by the use of photoelectric cells or other contactless or contacting sensors.

The detection or inspection apparatus (20) may be arranged on one side or on both sides of the needle board (2). An optical needle inspection is preferably performed on the front side of the board and with view to the tip of the needle, whereby deformations or the absence of the needle (4) can also be detected. As an alternative or in addition, an optical inspection apparatus, e.g., a photoelectric cell array, can determine on the rear side of the board and in the area of the needle placement apparatus (13) whether a needle (4) was pushed out at all during the needle removal.

Figure 14:
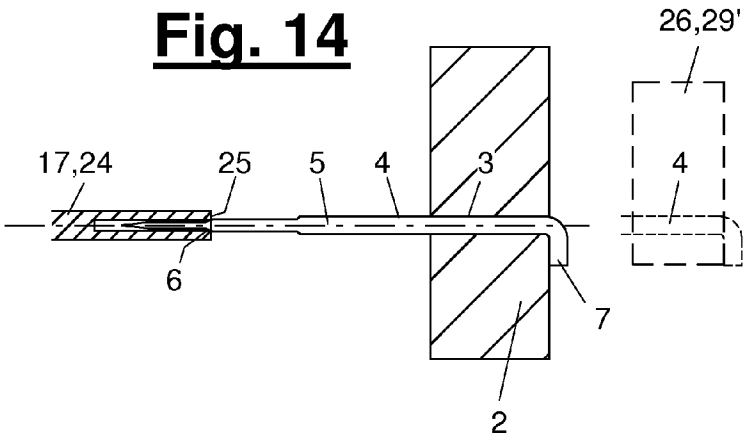
FIG. 14 is a schematic view of a needle and of an ejection tool.
Figure 13:
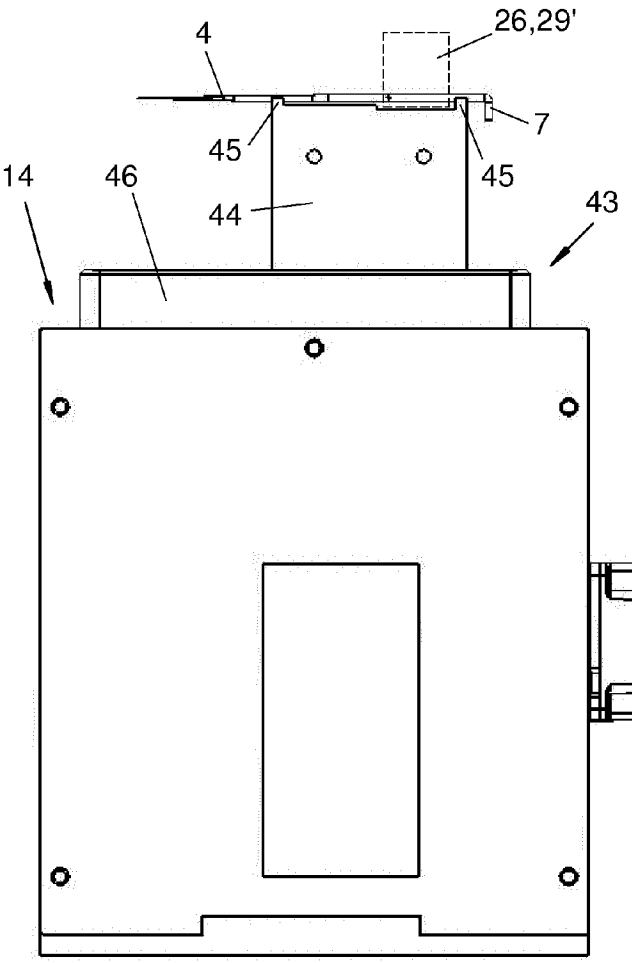
FIG. 13 is a schematic side view of a guide apparatus with a needle separating apparatus.

In the exemplary embodiments shown, the detection apparatus (20) has a control apparatus for the needle stroke during the at least partial removal, especially during the ejection of a needle (4). FIG. 14 shows a schematic example for this.

The needle removal tool (17) of the needle removal apparatus (12) is designed here as an ejection tool (24) in the form of a cylindrical ejection sleeve. The ejection sleeve is adapted to the outer contour of the needle (4).

The needle (4) has a shank (5) with a tip along with an optional barb or the like at the front end and with a so-called needle crank (7) at the rear end. The needle crank (7) is also called crank and is formed, for example, as a right-angle bend of the shank end, as a result of which a mechanical stop is formed at the edge of the receptacle opening (3).

The shank (5) has, in addition, varying thicknesses and possibly lengths. The thin tip is adjoined by a first shoulder (6) and optionally another shoulder. One or both shoulders (6) may act as a mechanical stop for the ejection sleeve (24), so that the needle (4) is pushed at least partially rearward from the receptacle opening (3) by the corresponding advancing apparatus (19) during the feed of the ejection sleeve (24).

The needles (4) may be placed at the needle board (2) with different, preset rotation positions about their longitudinal axes. The tips with their barbs and the crank (7) may be aligned correspondingly differently. The rotary alignment of the crank is therefore preferably set during the needle placement.

In addition or as an alternative, the insertion depth in the receptacle opening may optionally be set. The needles (4) are preferably pushed in until the crank comes into contact with the needle board (2). As an alternative, they may be inserted only partially.

The ejection sleeve (24), especially its inner shape, is adapted to the outer contour of the needle (4). The inner diameter of the sleeve is so large that the tip of the needle is received during the advancing in the sleeve opening with a lateral clearance and possibly without contact or the risk of damage and the ejection sleeve (24) comes into contact with its front-side sleeve edge (25) with one of the rear shoulders (6).

To control the needle stroke, the advancing apparatus (19), which likewise has a drive and a measuring system for the displacement and/or position, is connected to the detection apparatus (20) and, furthermore, to the control (22). A lack of or damage to the needle (4) can be detected from an unusual lifting behavior of the advanced ejection tool (24). If a needle (4) is missing, it will not come into contact with the sleeve at the intended point. A stop can be detected by a force of resistance acting on the drive of the advancing apparatus (19), which can be detected, for example, based on an increased power consumption of an electric drive motor, a force sensor or the like. A similar situation develops if the tip of the needle is broken off behind the first shoulder (6). The ejection sleeve (24) now first comes into contact with the next shoulder (6) and performs for this an unusually long advancing stroke, which can be detected and compared with a preset value. The needle removal apparatus (12) may have, furthermore, a controllable extraction device (26) for extracting an at least partially ejected needle (4) from the receptacle opening (3). The extraction device (26) is arranged on the opposite side of the needle board (2) and may be designed, e.g., as gripper jaws. FIGS. 11 through 14 illustrate the arrangement. The gripper jaws may, in turn, be part of the needle placement apparatus (13).

The automatic needle placement machine (1) has, further, the utilization apparatus (21) mentioned in the introduction for removed needles. This makes it possible to transfer reusable needles (4) to another location on the needle board (2). As an alternative or in addition, it may dispose of needles (4) that are unfit for use via a discharge unit. The utilization apparatus (21) has, e.g., a receptacle for needles (4) that are unfit for use and a magazine (37) for receiving needles (4) that can continue to be used in a temporary, defined and localized manner.

The control (22) knows for all reusable needles (4) what quality these have and at what location they are being stored temporarily in the magazine (37) in order to be able to be gripped in a targeted manner for a renewed when needed. A data set with an identification and information on properties of the needle can be assigned to each needle (4) during use in the automatic needle placement machine (1). This information may pertain to the type and design of the needle (4), the history thereof with placement locations and length of use on the needle board (2), possible wear phenomena or damage, etc.

A program (23) for needle identification and needle flow control may be contained in the control (22). For example, a zone-by-zone transfer of needles (4) may take place in this connection corresponding to the current state of wear thereof in order to achieve a constant progression of wear and a longer service life. The needle information also includes information on the temporary storage location and possibly the alignment of the needle (4) in the magazine (37). A transfer may be performed, furthermore, cyclically.

Figure 4:
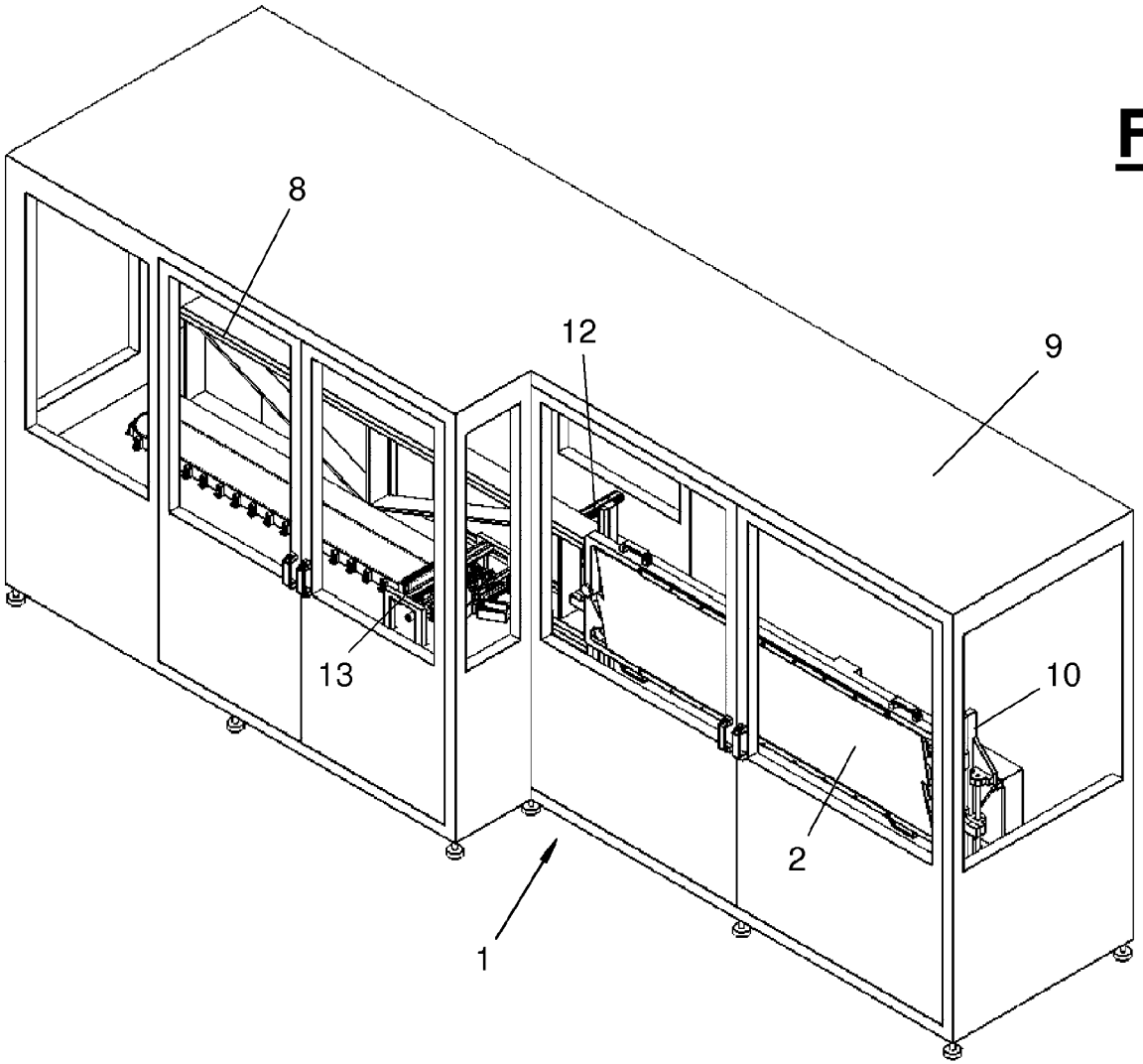
FIG. 4 is a perspective view of an enclosed automatic needle placement machine.
Figure 5:
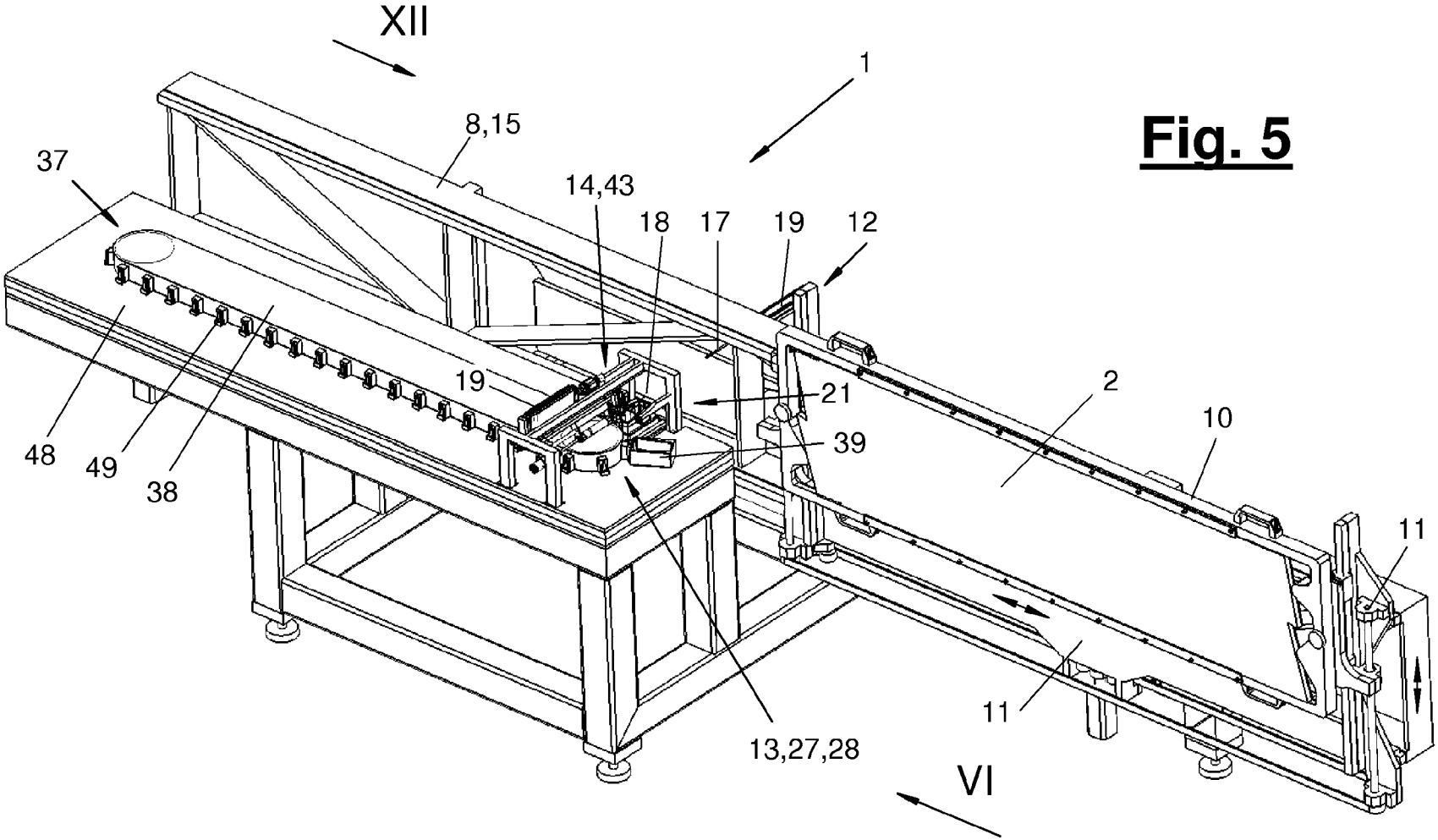
FIG. 5 is a perspective view of the automatic needle placement machine without housing.
Figure 6:
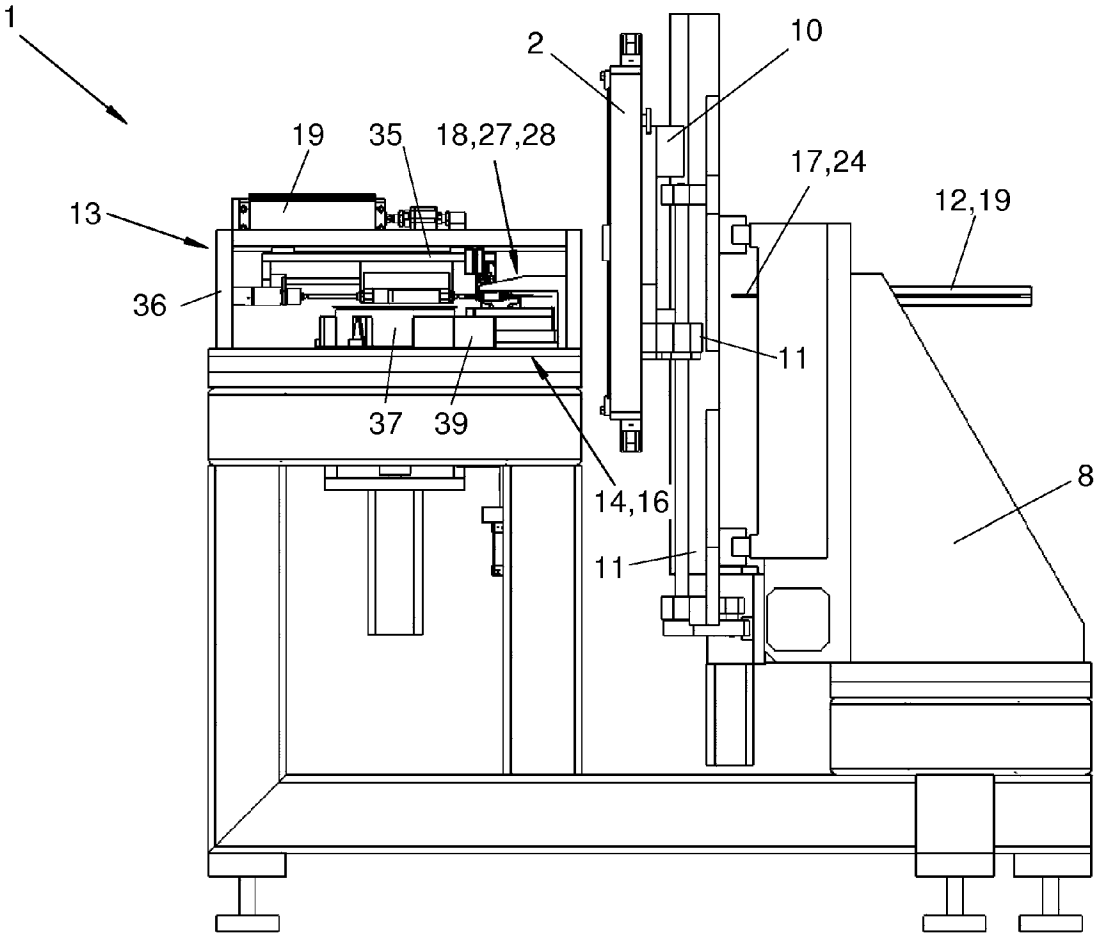
FIG. 6 is a front view of the automatic needle placement machine according to arrow VI in FIG. 5.
Figure 7:
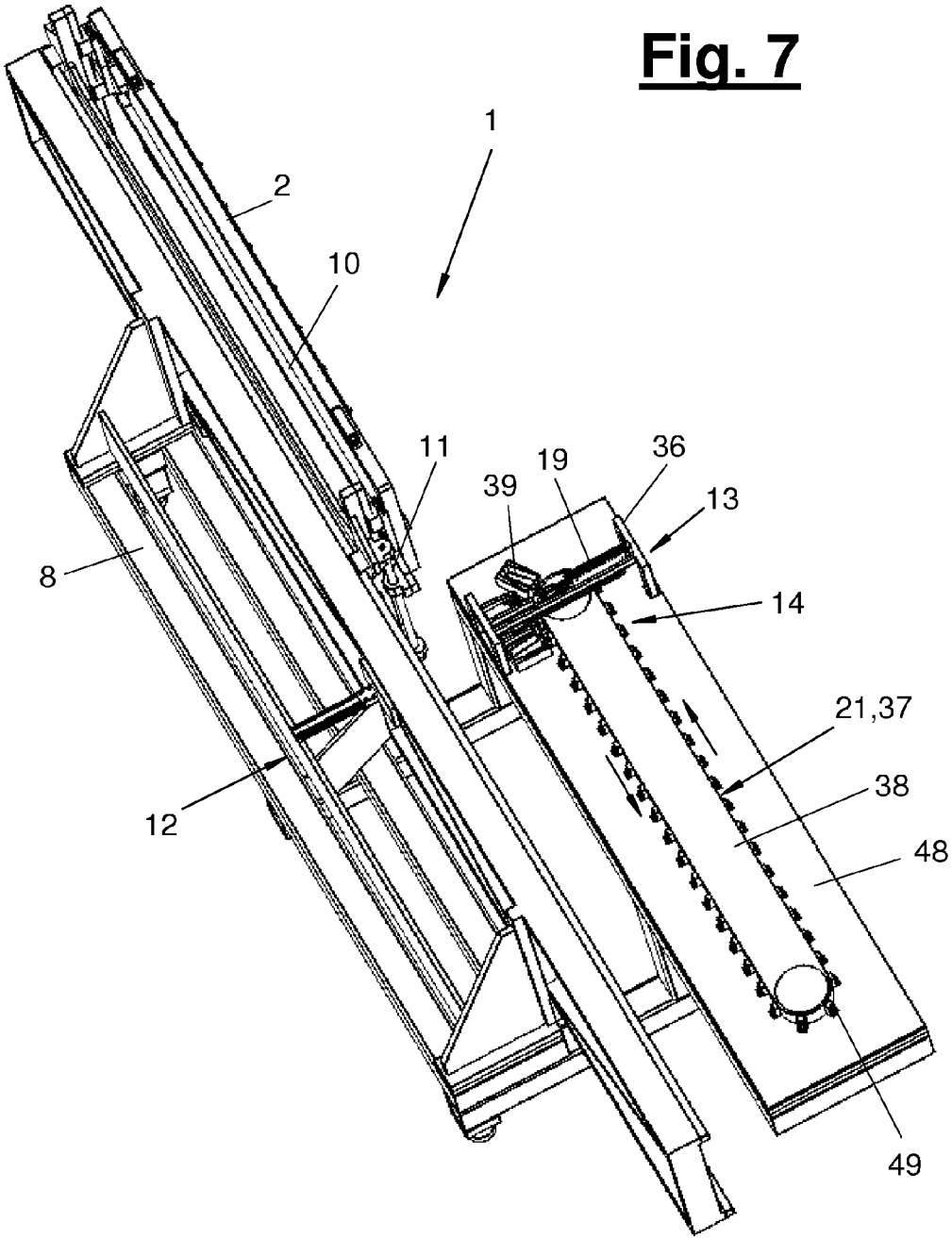
FIG. 7 is a perspective top view of the automatic needle placement machine from FIG. 5.
Figure 8:
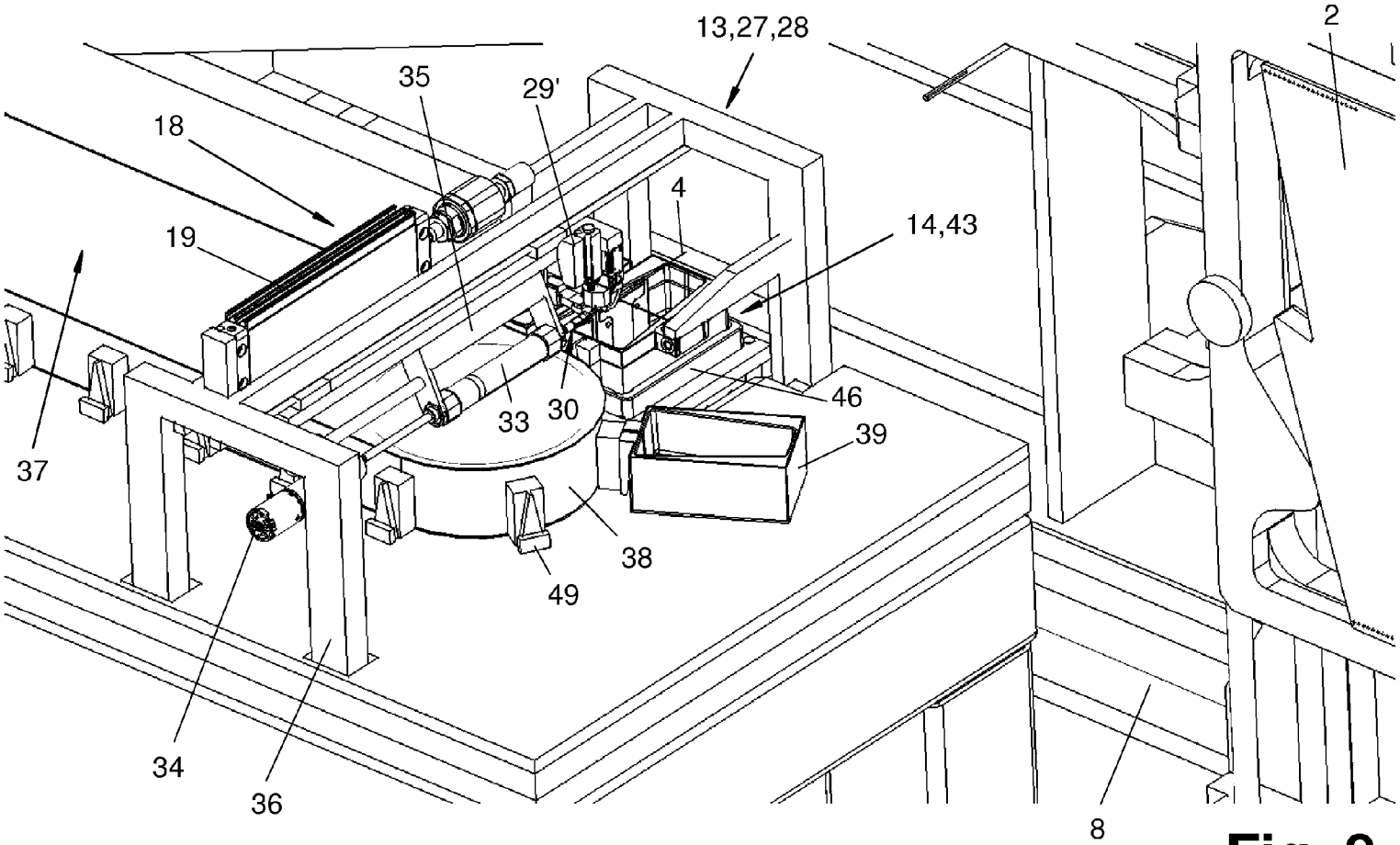
FIG. 8 is a perspective detail view of a needle placement apparatus of the automatic needle placement machine.
Figure 9:
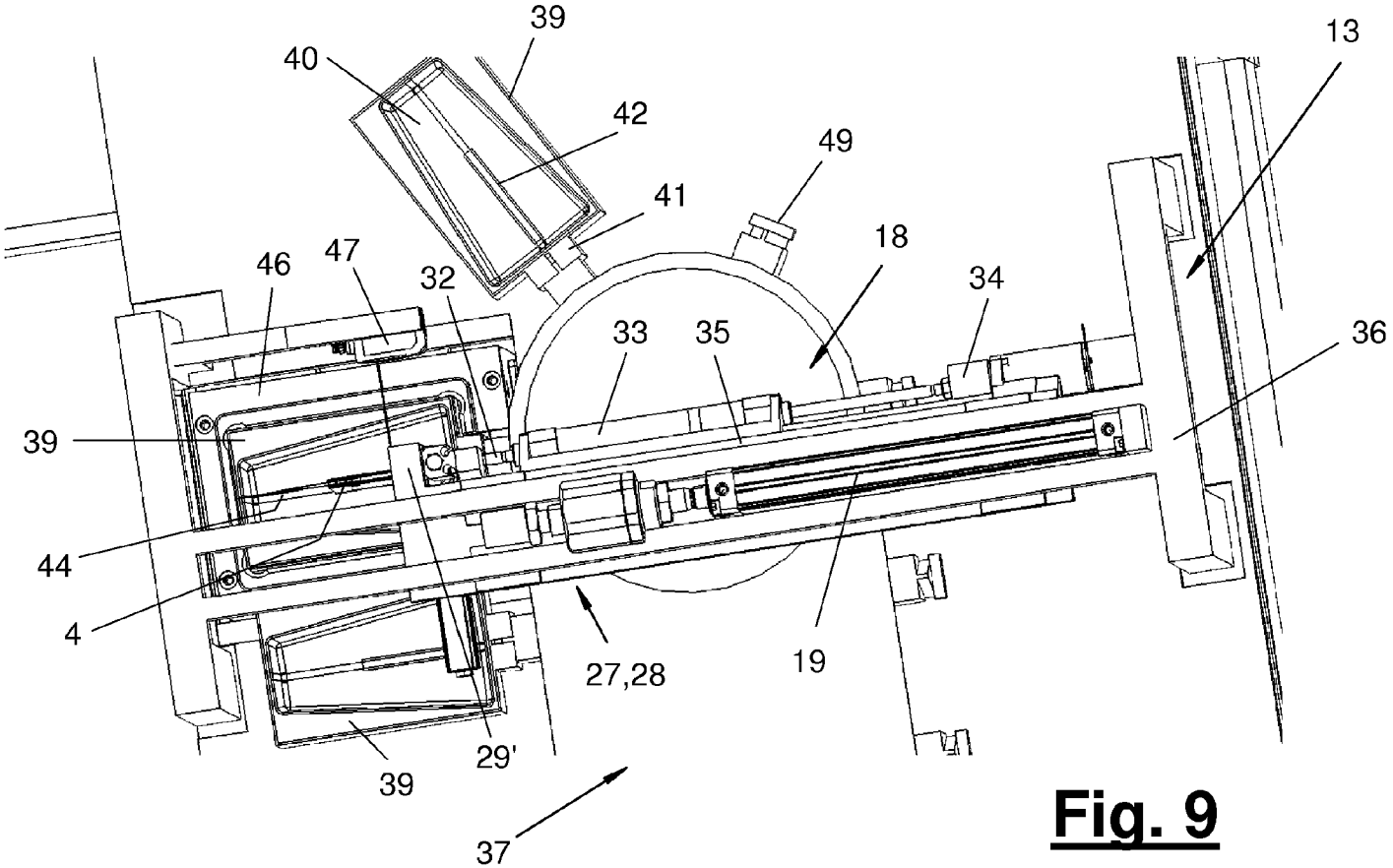
FIG. 9 is a perspective top view of the needle placement apparatus from FIG. 8.
Figure 10:
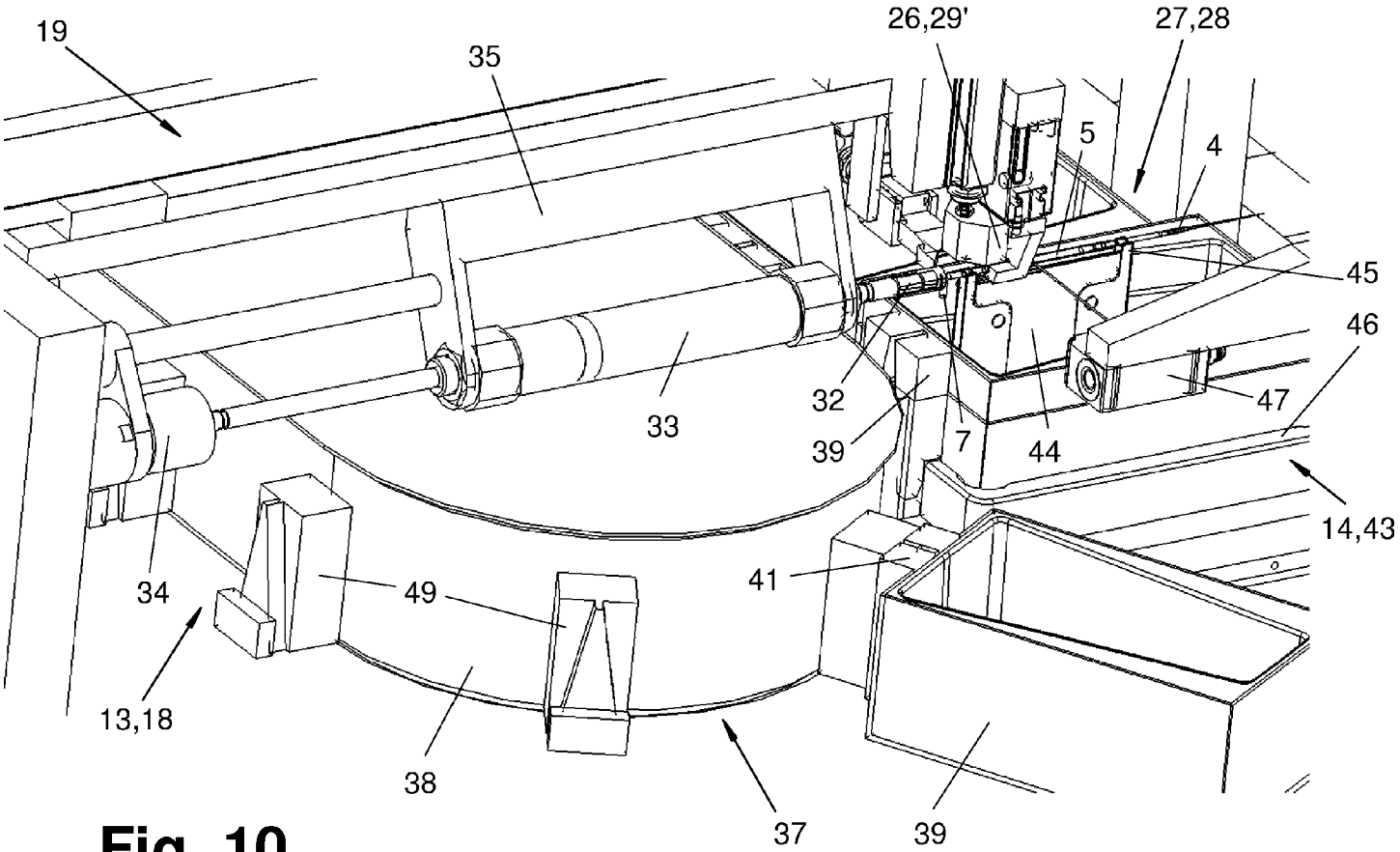
FIG. 10 is another enlarged detail view of a detail of the needle placement apparatus from FIG. 8.
Figure 11:
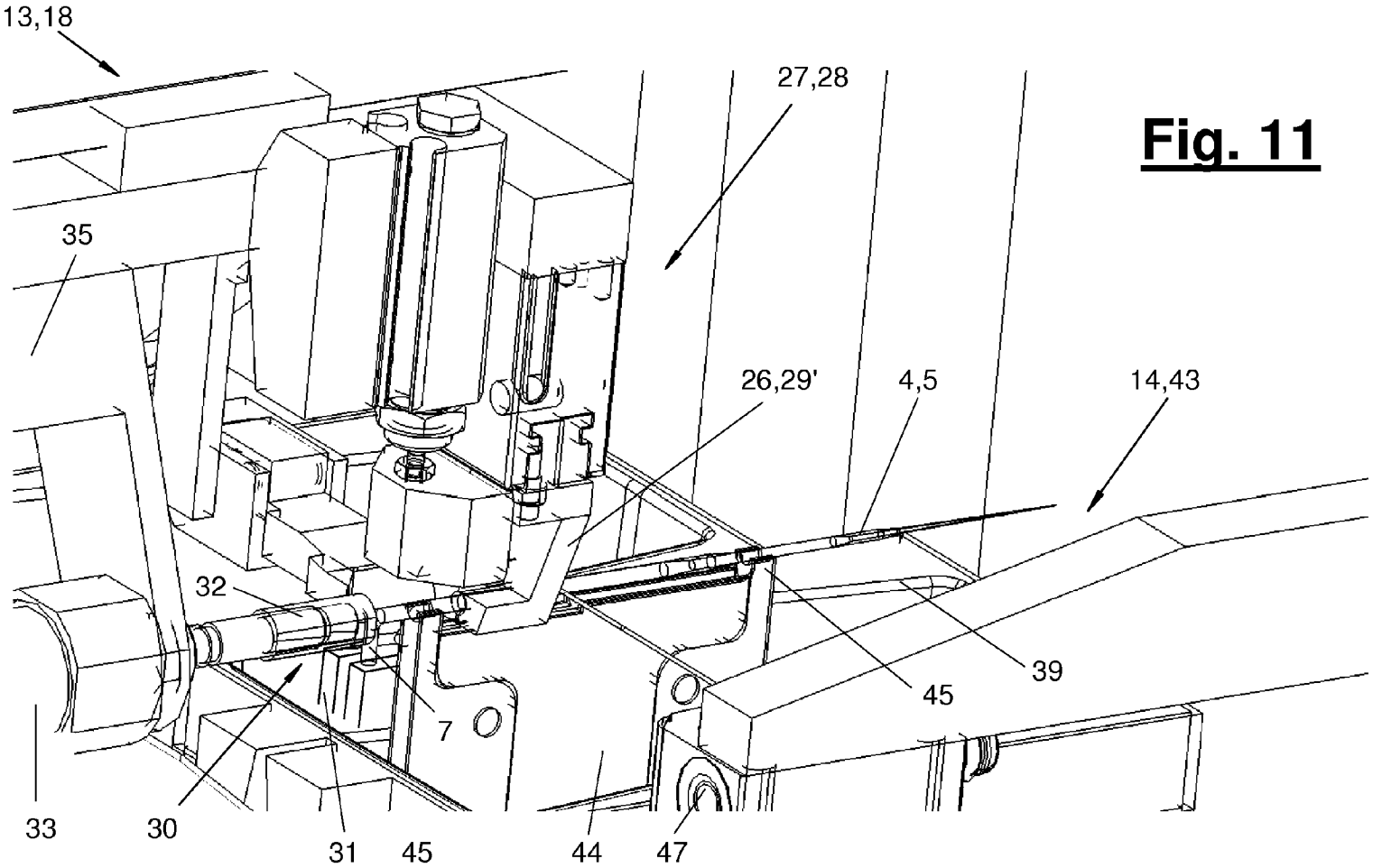
FIG. 11 is another detail view of a detail of the needle placement apparatus.
Figure 12:
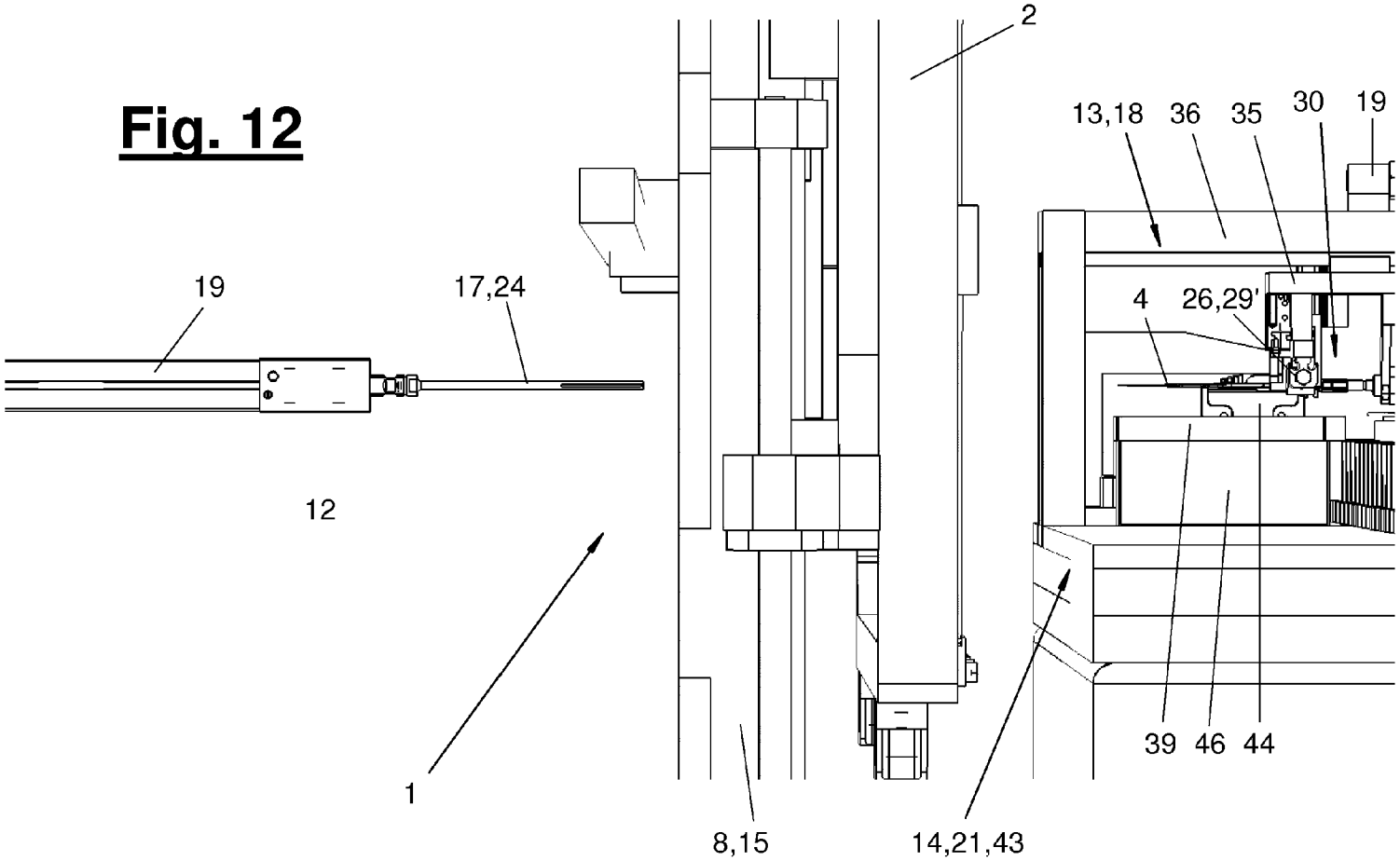
FIG. 12 is a partially cut-away front view of a needle board and the bilateral arrangement of a needle removal and needle placement apparatus according to arrow XII in FIG. 5.

FIGS. 5 through 14 show a preferred design embodiment of the automatic needle placement machine (1). This may be surrounded, e.g., according to FIG. 4, by a housing (9), and needle boards (2) can be transported into and out of the housing (9) through front-side doors. The needle removal and needle placement apparatuses (12, 13) are preferably arranged relatively stationarily in relation to the holding apparatus (10). They are located at a machine frame (8), which forms a mechanical connection in the manner of the aforementioned frame (15) with durable and accurate mutual positioning of the apparatuses (12, 13).

The needle placement apparatus (13) has the aforementioned needle placement tool (18) and a controllable advancing apparatus (19), with which at least a part of the needle placement tool (18) can be advanced into a working position at the needle board (2). The advancing apparatus (19) has, e.g., in the exemplary embodiment according to FIGS. 1 through 14, a slide (35) movable linearly in the horizontal and advancing direction at a frame (36) and a controllable advancing drive with a measuring system for detecting the displacement and/or position. The advancing apparatus (19) may also be eliminated. The needle placement apparatus (13) and the needle board (2) are positioned relative to one another by means of the positioning apparatus(es) in the working position, so that the longitudinal axes of the needle (4) and of the receptacle opening (3) are aligned with one another.

Figure 15:
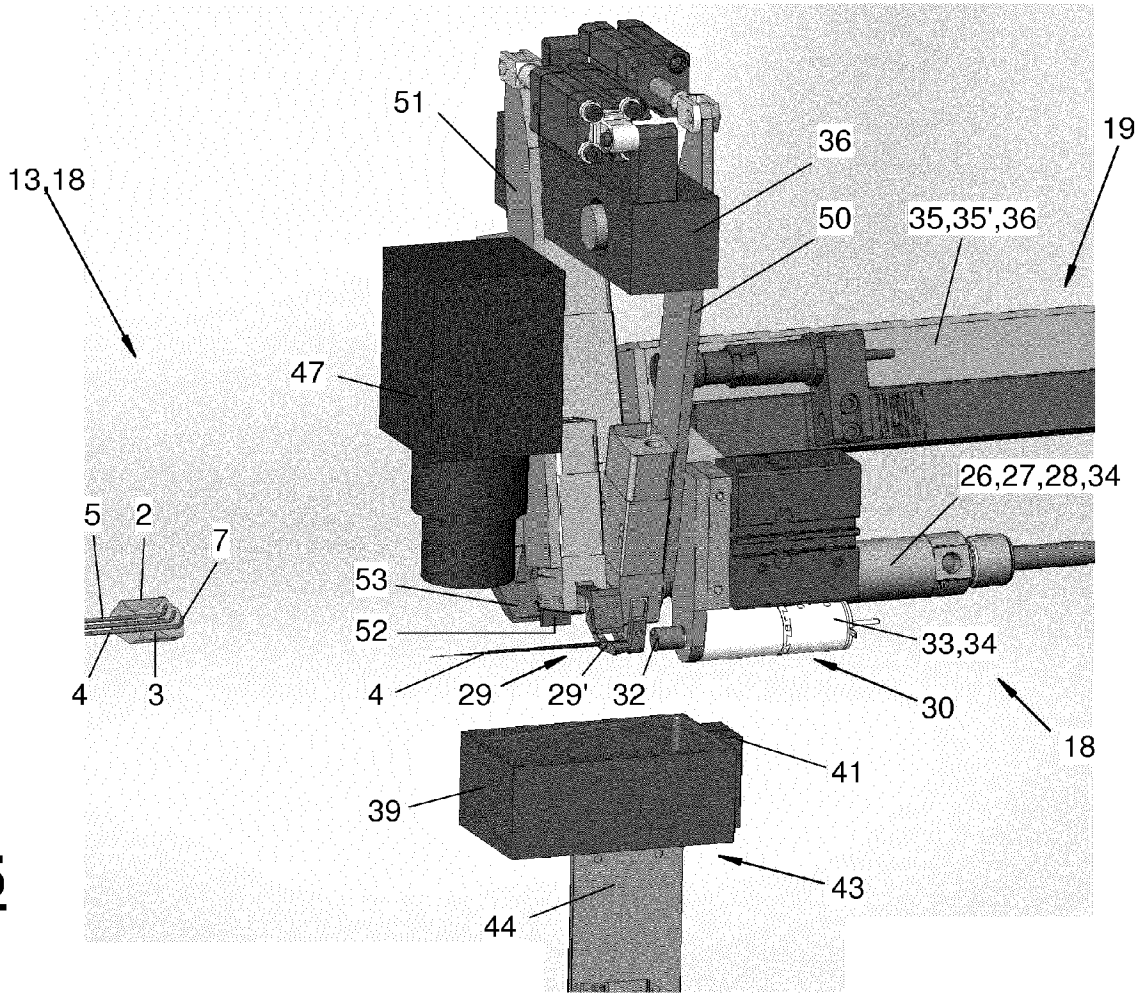
Figure 16:
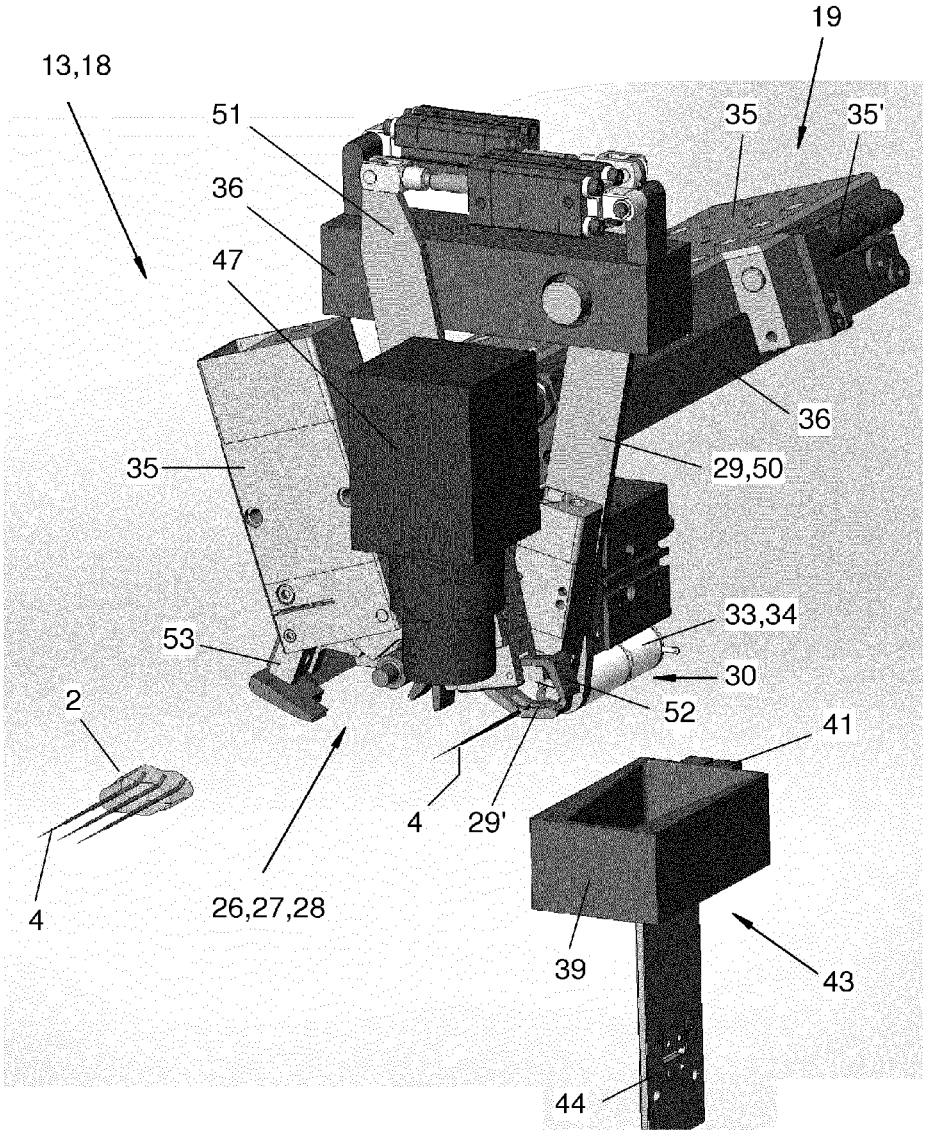
FIG. 16 is another perspective view showing the needle placement apparatus from FIG. 15.
Figure 17:
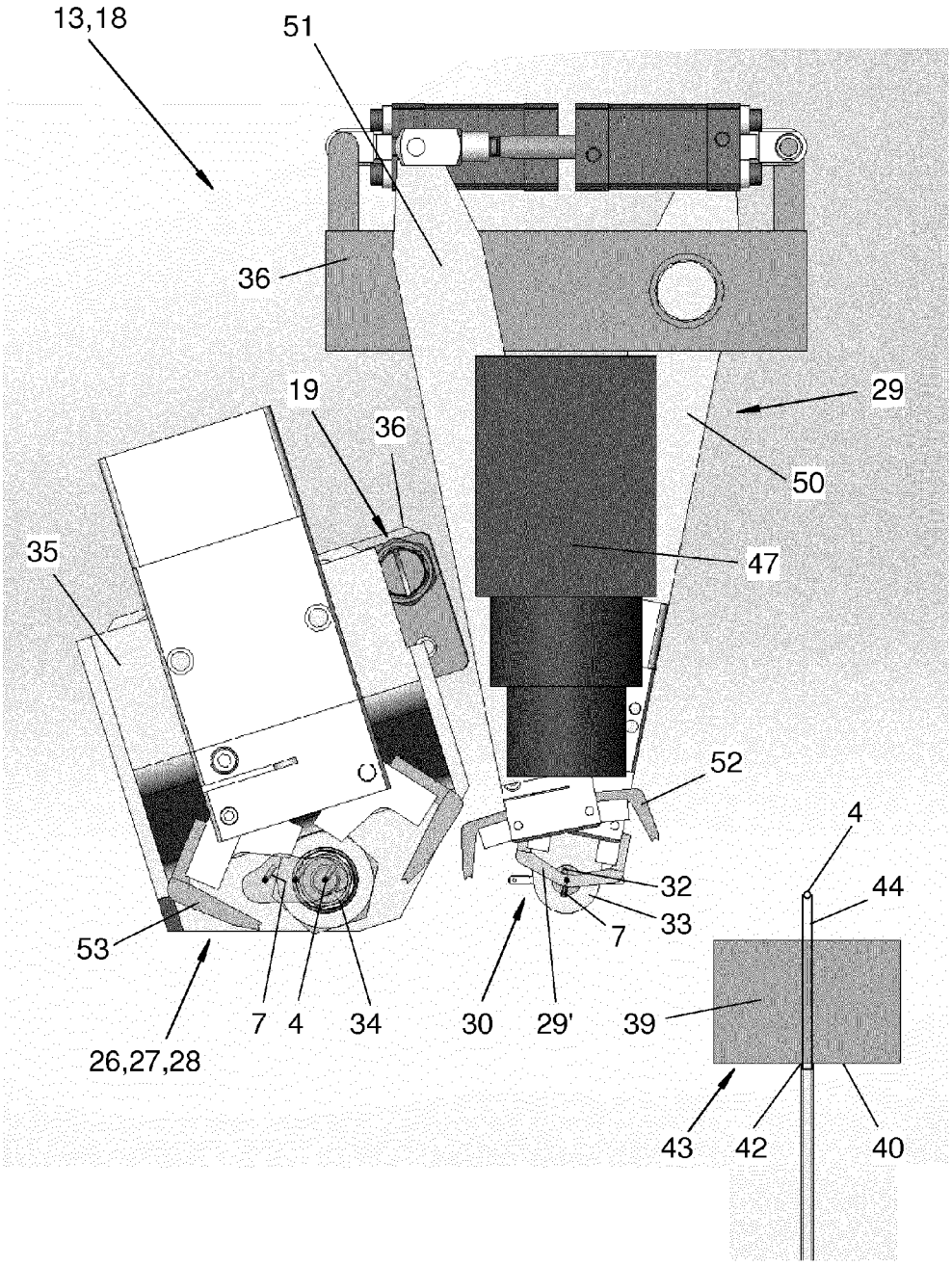
FIG. 17 is a front view of the needle placement apparatus from FIG. 15.
Figure 18:
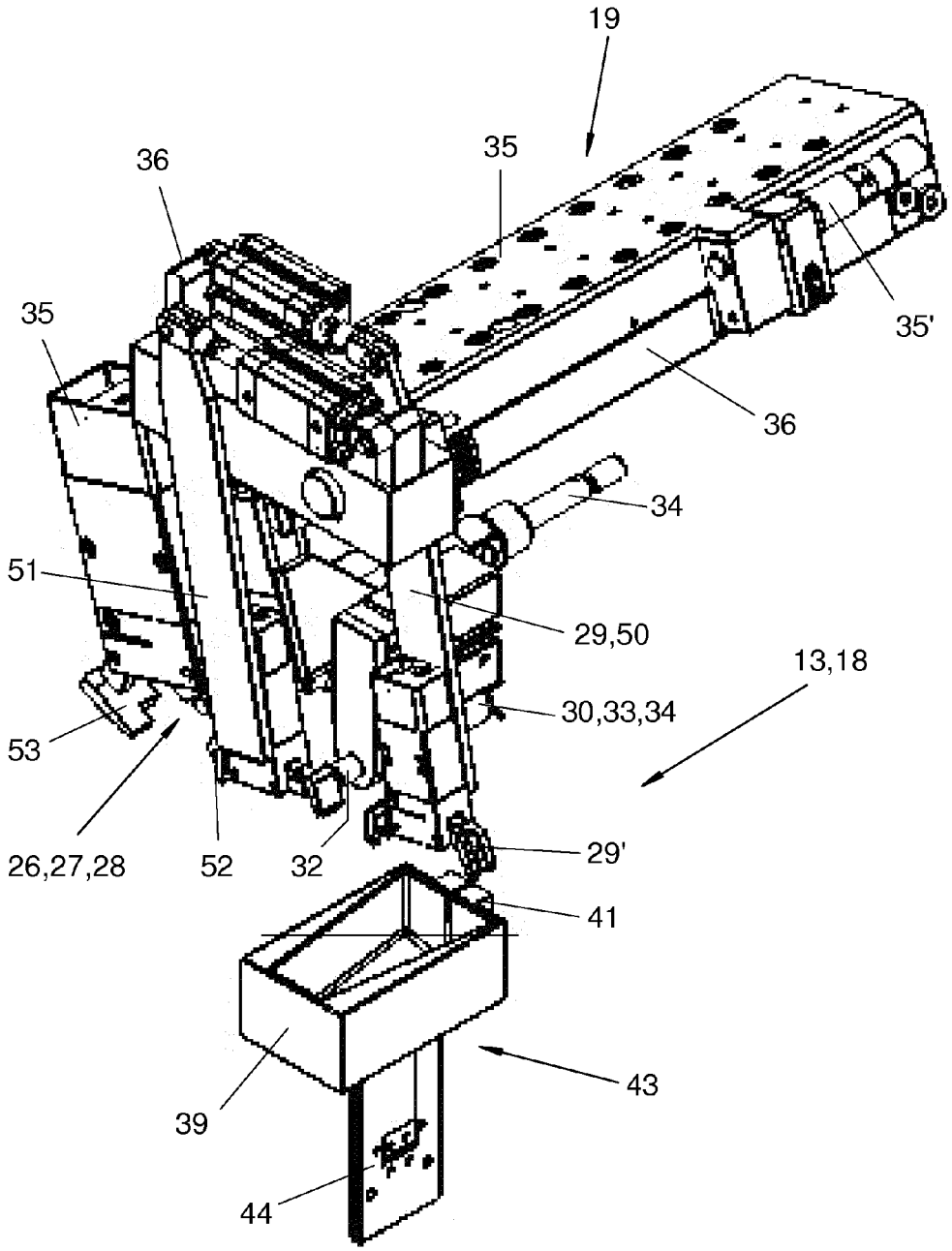
FIG. 18 is another perspective view of the needle placement apparatus from FIG. 15.
Figure 19:
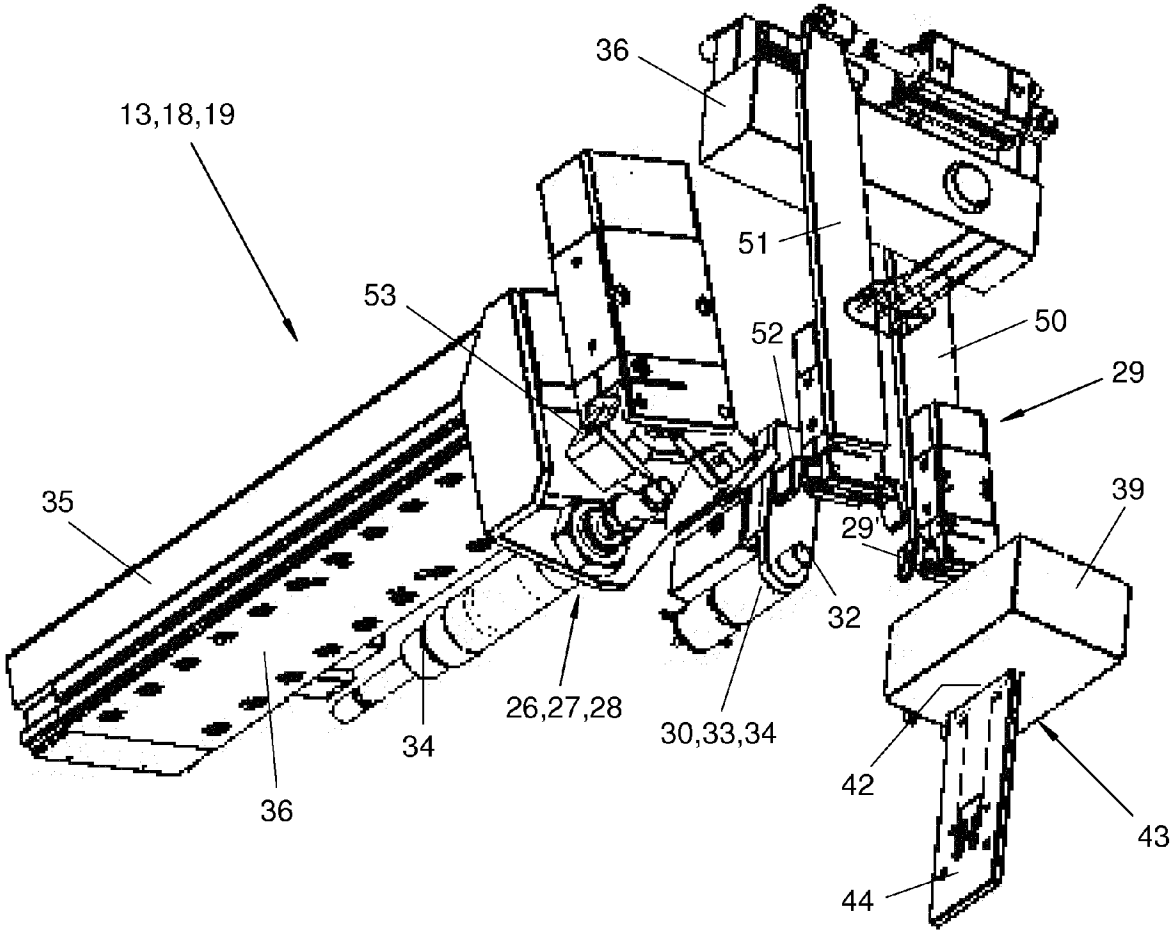
FIG. 19 is a further perspective view of the needle placement apparatus from FIG. 15.

FIGS. 4 through 14 show a first embodiment of the needle placement apparatus (13). FIGS. 15 through 19 show a second embodiment of the needle placement apparatus (13). The needle board (2) is shown in FIGS. 15 and 16 as a detail each with three inserted needles (4). The controllable components of the needle placement apparatus (13) are connected to the control (22).

The needle placement apparatus (13), especially its needle placement tool (18), has an insertion device (27) and a push-in device (28) for inserting a needle (4) in a receptacle opening (3) of the needle board (2) in the first embodiment according to FIGS. 4 through 14. There are different design embodiment possibilities for this. Both devices (27, 28) are preferably arranged together on the slide (35) of the advancing apparatus (19) and are advanced via this apparatus horizontally onto the upright needle board (2).

The needle placement apparatus (13), especially the insertion device (27), has a needle holder (29'), e.g., a controllable gripper jaw, as well as a translatory and/or rotary needle aligner (30). The needle holder (29') may also form the extraction device (26) for a needle (4) at the same time when it is being moved against the advancing device and away from the needle board (2). The needle holder or gripper jaw (29') grips an individual needle (4) by the shank (5) and holds it in a forwardly directed horizontal piston. During or after insertion of the needle (4) with the front area of the needle into the receptacle opening (3), the push-in device (28) can come into action, and it will then feed the inserted needle (4) axially farther up to the stop of the crank (7) at the needle board (2) with the needle holder (29') opened or switched to the powerless state.

The needle aligner (30) may bring about, on the one hand, the axial alignment along the axis of a receptacle opening (3), but, on the other hand, this may also be the function of the feeding apparatus (14) explained below. A rotary needle aligner (30) ensures a correct rotation position of a needle (4) about its longitudinal axis for prepositioning and during the insertion in the receptacle opening (3).

The needle aligner (30) may have for this a prepositioning device (31), which aligns the crank (7) of the received needle (4) in a predefined position, and it is directed, e.g., vertically downwards. A prepositioning device (31) may likewise interact with the feeding apparatus (14). It may be designed, e.g., according to FIG. 11, as an ejector, which has two brushes located at spaced locations or fixed guide surfaces, between which the needle (4) is moved during the feed to the needle holder (29'), wherein a possibly obliquely positioned crank (7) is contacted and is then aligned along the feed direction by a rotation of the needle.

A rotary needle aligner (30) may have, furthermore, a rotary gripper (32) with a controllable rotary drive (33) for the needle crank (7) for setting the rotation position during the insertion in the needle board (2). The rotary gripper (32) is designed, e.g., as a slotted or grooved sleeve or the like, which extends over the rear needle end and the crank (7) in a positive-locking and rotationally engaged manner. The rotary gripper (32) may be rotated by the controllable rotary drive (33) about its longitudinal axis or the needle axis.

The rotary gripper (32), may, in addition, be in connection with the push-in device (28), especially the pushing drive (34), and fed by this. As an alternative, a separate arrangement is possible. The pushing drive may have, e.g., a piston rod or adjusting rod, which passes centrally and axially through the rotary drive (33) and which is possibly co-rotated. FIGS. 8 through 11 illustrate this design and the horizontal alignment in the advancing direction.

The automatic needle placement machine (1), especially the needle placement apparatus (13), has the aforementioned feeding apparatus (14), which is used to separate needles (4) and feed them in the correct position to the needle placement tool (18). The feeding apparatus (14) may have a magazine (37) for, e.g., new needles (4). The magazine (37) may also be the magazine for the utilization apparatus (21). The feeding apparatus (14) has, in addition, a separating apparatus (43) for separating and aligning needles (4) as well as for feeding same in the correct position. There are different design embodiment possibilities for this.

In the exemplary embodiments being shown, the magazine (37) has a conveyor (38) with one or more needle containers (39), which contain each one or more new or reusable needles (4). The feeding apparatus (14) interacts with the insertion device (27) and the push-in device (28) and transports there the one or more needle containers (39 and the needles (4) to these.

The conveyor (38) is designed, e.g., as a circulating conveyor and is arranged on a table (48). Arrows in FIG. 7 indicate the horizontal circulation direction. The circulating conveyor (38) is designed, e.g., as a belt conveyor and has a flexurally elastic belt, which runs around horizontally arranged deflecting and drive wheels with vertical axis of rotation and which has a plurality of carriers (49) located at spaced locations in the axial direction on the outer side for the positive-locking carrying of one needle container (39) each in a correct position.

In the preferred embodiment, the separating apparatus (43) is adapted to the needle container (39) and has a controllably driven lifting post (44), which can move vertically up and down and reaches in the process through a slot (42) in the bottom (40) of the positioned needle container (39). The lifting post (44) has a shaft, which closes the slot (42) against an undesired discharge of the needle. Further, the lifting post (44) has a support (45) with two or more support arms for an individual needle (4), which support is preferably arranged on the top side of the post. The support (45) may be used to align the needle linearly and as a prepositioning device (31), extending horizontally and in the advancing direction.

The separating apparatus (43) has, furthermore, a movable, especially controllable container guide (46) for receiving, positioning and supporting a needle container (39). The slot (42) is positioned here above the lifting post (44) in a correct position for passing through it. The needle container (39) may have on one side a connection (41) for the positive-locking interaction with a carrier (49). There may be a mobility in the vertical direction. The container guide (46) may be connected to the positioning apparatus (16) and can be raised and lowered in a controlled manner for receiving a needle container (39) sliding on the table surface. The needle container (39) is surrounded here by, e.g., a collar of the container guide (46), which collar extends around the outside.

The needle container (39) has a preferably elongated shape adapted to the needle geometry. It can receive a stock of needles (4) with a certain forward position along the longitudinal axis of the container. The lifting post (44) is used to separate and feed an individual needle (4) to the needle placement tool (18), especially to the needle holder (29'), and it interacts with these components (18, 29'). The supports (45) are adapted to the geometry of the needle and are designed, e.g., as arms with upwardly open receiving troughs. The length of the container corresponds essentially to the length of the needle, which ensures an axial prepositioning of the needles (4) at the lifting post (44) during the positioning of the needle container (39).

A needle (4) located in a suitable position is carried during the upward motion of the lifting post (44) through the stock of needles and gripped and held with both supports (45) located at axially spaced locations, and the other needles (4) fall off. The container bottom (40) may have a shape recessed in a tub-like manner toward the central slot (42), which shape is favorable for receiving. The length of the slot (42) and the corresponding width of the lifting post (44) may be shorter than the length of the needle.

The separating apparatus (43) may have a sensor (47) shown in FIGS. 8 through 11, e.g., a photoelectric cell, for detecting the existence and the position of a separated needle (4) at the lifting post (44) and in the supports (45). The supports (45) may project somewhat over the upper edge of the post so that the needle (4) can be held floatingly and gripped by the needle holder (29'). The upper end of the post may also have a contour favorable for gripping for this As soon as the separated needle (4) is transferred to the needle holder (29'), the lifting post (44) can again be lowered and it can separate and receive the next needle (4).

The needle containers (39) are detachably connected to the carriers (49) and they are inserted there, e.g., with their connections (41). Oblique guide surfaces on the parts (41, 49) ensure centering and positive-locking guiding. Lowering of the needle containers (39) can be prevented by this positive-locking connection, and an upward lifting motion and corresponding carrying by the container guide (46) are, on the other hand, possible. The container guide (46) now assumes the guiding and centering function, and any positioning inaccuracies of the conveyor (38) are compensated.

The needle containers (39) can be replaced as needed. This is used, e.g., to replace empty containers with full ones. On the other hand, other containers or supports or other holding apparatuses may be used for one or more needles (4) to form a temporary intermediate storage of the utilization apparatus (21) and replaced as needed with needle containers (39) for new needles (4).

The second variant of the needle placement apparatus (13) according to FIGS. 15 through 19 is of independent inventive significance. It may also be used in other automatic needle placement machines and kinematics, especially those known from the state of the art mentioned in the introduction.

In the second variant, the needle board (2) is preferably moved according to FIG. 1 with linear space axes (x, z) horizontally and vertically relative to the needle placement and needle removal apparatuses (13, 12), which are preferably stationary or relatively stationary in relation to the needle board (2). The holding apparatus (10) is connected for this to a multi-axis positioning apparatus (11), which has, e.g., a cross slide with controllable drives and with measuring apparatuses along with a connection to the control (22).

The second variant may also be used, as an alternative, in other kinematic variants. The needle removal and needle placement apparatuses (12, 13) may be moved here by means of a positioning apparatus relative to a likewise moved needle board (2) or to a relatively stationary needle board (2). Aside from the three kinematic variants mentioned, there are further alternatives and mixed forms.

In the second variant, the needle placement apparatus (13), especially its needle placement tool (18), likewise has an insertion device (27) and a push-in device (28) for inserting a needle (4) in a receptacle opening (3) of the needle board (2). The needle placement apparatus (13), especially its needle placement tool (18), has, in addition, a receiving device (29) for a separated needle (4) and a device (30) for aligning a needle (4). The aligning device (30) is also called needle aligner (30). Furthermore, a needle separating apparatus (43) for needles (4), which is integrated or associated in another way, may also belong to the needle placement apparatus (13). The separating apparatus (43) may also be part of the feeding apparatus (14).

The receiving device (29) for an individual needle (4) has a needle holder (29'), e.g., gripper jaws driven in a controlled manner, which grips an individual needle (4) by the shank (5) and holds it preferably in an especially horizontal position parallel to the receptacle opening. The needle holder (29') has, e.g., two or more jaws, which act on opposite sides on the needle shank (5) and which have a groove-like depression adapted to the shank area at the contact point. The needle (4) may be held or gripped in a positive-locking manner and with a radial clearance. Holding or gripping may permit rotation as well as axial displacement of the needle (4) at the needle aligner (30).

The receiving device (29) comprises, furthermore, a transport apparatus (50), with which the needle holder (29') can be moved in a reversing manner between a needle receiving location and the needle aligner (30). The needle receiving location is, e.g., the receiving location at the separating apparatus (43). The transport apparatus (50) has a controllable drive and has, e.g., a swivel arm, at the end of which the controllable needle holder or gripper jaws (29') are arranged.

A separated needle (4) received in the needle holder (29') is aligned by rotary and/or translatory motion for the needle placement process with the needle aligner (30). A rotary needle aligner (30) ensures, e.g., the correct rotation position of a needle (4) about the longitudinal axis thereof for prepositioning and for the subsequent insertion in the receptacle opening (3). The needle aligner (30) can also bring about the axial alignment of the needle for said prepositioning. For alignment, the gripper jaws (29') are moved with the needle (4) being held in a positive-locking manner to the area located in front of the needle aligner (30).

In the preferred embodiment being shown, the needle (4) can be moved farther to a preferably combined insertion and push-in device (27, 28) after the rotary and/or translatory alignment. An additional controllable, reversingly movable transport apparatus (51), which may likewise be designed as a swiveling apparatus or in another suitable manner, is provided for this.

The transport apparatus (51) has a controllable gripper (52), with which the aligned needle (4) can be taken over from the needle holder (29'). The gripper (52) may likewise be designed as gripper jaws of the aforementioned type driven in a controlled manner. It preferably holds the needle (4) in a non-positive manner or by clamping connection, so that the axial and rotary alignment of said needle is preserved. The transport apparatuses (50, 51) and their gripper jaws (29', 52) are arranged one after another in the longitudinal direction of the needle for the transfer process.

The insertion and push-in device (27, 28) likewise has a controllable gripper (53), which is preferably designed as driven and controllable gripper jaws and grips the transferred needle (4) in a non-positive manner to preserve the alignment thereof. An offset of the grippers (52, 53) in the longitudinal direction of the needle is provided for the transfer operation in this case as well. The gripper (53) may have the same arrangement and jaw width as the needle holder (29').

The separating apparatus (43), the needle aligner (30) and the combined insertion and push-in device (27, 28) are arranged at spaced locations next to each other in the exemplary embodiments being shown, and the needle (4) is transported and transferred by means of the transport apparatuses (50, 51). The transport apparatuses (50, 51) may be arranged on a common frame (36). They may have separate controllable drives or a common drive. The swivel arms are preferably arranged suspended and move in a plane parallel to the preferably upright needle board (2).

The needle aligner (30) has a rotary gripper (32) and a controllable rotary drive (33) as well as a feed or pushing drive (34) for setting the rotation position of the needle crank (7). The rotary gripper (32) is designed, e.g., as a cylindrical pressing head with a bolt arranged axially and eccentrically on its end face.

The rotary gripper (32) aligned parallel or preferably coaxially with the needle shank (5) is advanced by the feed drive from a withdrawn position to the needle (4) in the needle holder (29') and rotated at the same time or subsequently by the rotary drive (33) in a controlled manner about its longitudinal axis. The axial bolt now extends behind the crank (7) and carries it while the needle (4) is rotating until the preset rotation position that the rotary drive (33) seeks to reach is reached. In addition, the translatory alignment of the needle (4) can be brought about via the axial feed. It is subsequently taken over in this aligned position by the gripper (52) in the above-described manner and transferred to the insertion and push-in device (27, 28).

The insertion and push-in device (27, 28) may be coupled with the advancing apparatus (19). The latter has a carrier (35), e.g., a displaceable slide, which can be moved towards the needle board (2) in the advancing direction and is acted on by a controllable advancing drive (35'). Said gripper (53) as well as a controllable rotary drive (33) are arranged at the slide (35) at the end face. The pushing drive (34) is arranged aligned behind the gripper (53) and acts on the rear side on the needle (4), especially the crank (7), with an extensible pressure ram or the like. The advancing direction is directed in parallel to the longitudinal axis of the receptacle opening (3).

The slide (35) is mounted displaceably at a frame (36) and is acted on by a controllable advancing drive (35'), which may have a measuring system for displacement and/or position detection. The needle (4) being held by the gripper (53) in the set alignment is directed such that it is aligned with the receptacle opening (3) and is inserted in the receptacle opening (3) by the feed of the carrier or slide.

The needle (4) can then be fed farther forward by the pushing drive (34), while its rotary alignment is preserved, and pushed into the final needle position in the needle board (2), while the gripper (53) is opened. The insertion depth may be selected and set as desired. The crank (7) may preferably be brought into contact with the needle board (2).

The insertion and push-in device (27, 28) may also be used as an extraction device (26) for extracting partially pushed-out needles (4) in the manner mentioned in the introduction. Upon a signal of the needle removal apparatus (12), the extraction device (26) moves with opened gripper (53) forward to the needle board (2). The subsequently closed gripper (53) grips the needle (4), which is then extracted from the receptacle opening (3) by a return stroke motion of the slide (35). In the withdrawn or inoperative position of the device (26, 27, 28), the removed needle (4) can then be brought back by the transport apparatuses (51, 50) and the grippers (52, 29') thereof to the needle container (39) or to another location and fed to the utilization apparatus (21).

The needle placement tool (18) may have a monitoring apparatus (54), which is designed, e.g., as a digital camera and is arranged at the frame (36). It may be associated with the needle aligner (30). It can view there the needle holder (29'), the needle (4) being held and optionally the crank (7) as well as the extended rotary gripper (32) and optically detect the presence, position as well as function of these devices. The monitoring apparatus (54) may be connected to the control (22).

The automatic needle placement machine (1), especially the needle placement apparatus (13), has the aforementioned feeding apparatus (14), which is used to separate and feed needles (4) in the correct position to the needle placement tool (18). The feeding apparatus (14) may have a magazine (not shown) for, e.g., new needles (4). The magazine may also be at the same time the magazine for the utilization apparatus (21). The feeding apparatus (14) or the needle placement tool (18) has, in addition, a separating apparatus (43) for separating and aligning as well feeding the needles (4) in the correct position. There are various design embodiment possibilities for this.

The magazine has, e.g., similarly to that in the first exemplary embodiment, a conveyor (not shown) with one or more needle containers (39), which contain each one or more new or reusable needles (4). The feeding apparatus (14) interacts with the needle placement tool (18) and transports there the one or more needle containers (39) and the needles (4).

The separating apparatus (43) is adapted in the preferred embodiment to the needle container (39) and has a controllably driven lifting post (44), which can move vertically up and down and reaches in the process through a slot (42) in the bottom (40) of the positioned needle container (39). The lifting post (44) has a shaft, which closes the slot (42) against an undesired discharge of needles. Further, the lifting post (44) has a support (45) with two or more support arms for an individual needle (4), which said support is arranged on the top side of the post. The support (45) may be used for the linear alignment of the needle, and it extends horizontally and in the advancing direction.

The separating apparatus (43) may have, furthermore, a movable, especially controllable container guide (not shown) for receiving, positioning and supporting a needle container (39). The slot (42) is positioned here in the correct position for passing through. The needle container (39) may have on one side a connection (41) for the positive-locking interaction with a carrier of the aforementioned conveyor. There may be a mobility now in the vertical direction. The container guide (46) may be connected to the positioning apparatus (16) and can be raised and lowered in a controlled manner for receiving a needle container (39) sliding on a table surface. The needle container (39) is surrounded now in a positive-locking manner by, e.g., a collar extending circumferentially on the outside.

The needle container (39) has a shape that is adapted to the needle geometry and is preferably elongated. It can receive a stock of needles (4) with a certain forward direction along the longitudinal axis of the container. The lifting post (44) is used to separate and feed an individual needle (4) to the needle placement tool (18), especially to the receiving device (29), and interacts with these components (18, 29). The supports (45) are adapted to the needle geometry and are designed, e.g., as arms with upwardly open receiving troughs. The length of the container corresponds essentially to the length of the needle, which ensures an axial prepositioning of the needles (4) at the lifting post (44) during the positioning of the needle container (39).

A needle (4) located in a suitable location is carried during the upward motion of the lifting post (44) through the stock of needles and is gripped and held with both supports (45), which are located at axially spaced locations, and the other needles (4) fall off. The container bottom (40) may have a tub-like shape favorable for receiving, which is recessed downwards towards the central slot (42). The length of the slot (42) and the corresponding width of the lifting post (44) may be shorter than the length of the needle.

The separating apparatus (43) may have a sensor, not shown, e.g., a camera, for detecting the existence and the position of a separated needle (4) at the lifting post (44) and in the supports (45). The supports (45) may protrude somewhat over the upper edge of the post, so that the needle (4) can be held floatingly and gripped by the needle holder (29'). The upper edge of the post may also have a contour favorable for gripping for this. As soon as the separated needle (4) is transferred to the needle holder (29'), the lifting post (44) can lower again and separate and receive the next needle (4).

The needle containers (39) may be replaced as needed. This is used, e.g., to replace empty containers with full ones. On the other hand, other containers or supports or other holding apparatuses for one or more needles (4) may be used to form a temporary intermediate storage of the utilization apparatus (21) and replaced as needed with needle containers (39) for new needles (4).

The automatic needle placement machine (1) has, furthermore, the utilization apparatus (21) mentioned in the introduction for removed needles. This makes it possible to transfer needles (4) that can continue to be used to another location on the needle board (2). As an alternative or in addition, it can dispose of needles (4) that are unfit for use via a discharge unit. The utilization apparatus (21) has, e.g., a receptacle for needles (4) that are unfit for use and a magazine for the temporary, defined and localized receipt of needles (4) that can continue to be used.

The control (22) knows for all needles (4) that can continue to be used what quality they have and at which location they are being stored temporarily in the magazine in order to be able to be gripped in a targeted manner for repeated placement when needed. A data set with an identification and information on properties of the needle may be assigned to each needle (4) during use in the automatic needle placement machine (1). This information may pertain to the type and design of the needle (4), the history thereof with placement locations and the lengths of use on the needle board (2), possible wear phenomena or damage, etc.

A program (23) for needle identification and for a needle flow control may be contained in the control (22). For example, a zone-by-zone transfer of needles (4) corresponding to the current state of wear thereof may take place here in order to achieve a constant progression of wear and a longer service life. The needle information also includes information on the temporary storage location and possibly the alignment of the needle (4) in the magazine. Furthermore, a transfer may take place cyclically.

The automatic needle placement machine (1) has the aforementioned detection apparatus (20) for the needle quality. It is checked here whether the needles (4) are damaged or worn or are also missing. In addition, a distinction can be made in this connection on whether the detect or wear is great enough for the needles to have become unfit for use or whether tolerable defects or wear phenomena are present, which permit further use.

The detection apparatus (20) may have different designs. It may have, on the one hand, an optical inspection apparatus for the needle quality. This may be, e.g., a camera system, which performs a measurement of the needles (4), especially of the front tip and of the shank area (5) following it. Another possibility of inspection or measurement is the use of photoelectric cells or other contactless or contacting sensors.

The detection or inspection apparatus (20) may be arranged on one side or on both sides of the needle board (2). An optical needle inspection is preferably performed on the front side of the board and with a view to the tip of the needle, in which case deformations or the absence of the needle (4) can also be detected. As an alternative or in addition, an optical inspection apparatus, e.g., a camera, can determine on the rear side of the board and in the area of the needle placement apparatus (13) whether a needle is present and is arranged correctly during the needle placement and needle removal. This includes the checking of whether a needle (4) was pushed out during the needle removal.

Various variants of the embodiments shown and described are possible.

The needle placement and needle removal apparatus (13, 12) may be present as multiple apparatuses and function alternatingly or together in the manner of a placing tool. A plurality of needles (4) can be placed on or removed from the needle board (2) simultaneously as a result The receiving device (29) may hold, for example, a plurality of needles (4) next to each other and in an arrangement corresponding to the opening grid with a corresponding needle holder (29'). The other devices (27, 28, 30) of the needle placement tool (18) may be adapted correspondingly.

In particular, the design of the described components of the needle placement apparatus (13) may be modified. In a variation of the embodiment being shown, the insertion and push-in devices (27, 28) may be designed as separate devices in space, in terms of function and design.

In another variant, all or individual devices (27, 28, 29, 30) of the needle placement tool (18) may be integrated in assembly units and functional units. For example, the needle aligner (30) and the insertion and push-in device (27, 28) may be combined into one unit. The transport apparatuses (50, 51) are correspondingly adapted now, and a transport apparatus may possibly be eliminated.

The separating apparatus (43) with the lifting post (44) may also be used without a magazine (37) and without a conveyor (38). Further, in a variant of the examples shown, the separation may be separated from the needle receptacle. Said separating apparatus (43) may feed the separated needles (4) only to an intermediate deposit location, the needle holder (29) receiving the needle (4) from there.

In another variant, an alignment of the needle (4) and especially of the crank (7) may take place after the separation and in the gripped position at the needle holder (29). The needle aligner (30) and its prepositioning device (31) are designed and arranged correspondingly differently for this.

On the other hand, the needle placement apparatus (13) may have another type of separating device (43). This may be designed, e.g., as a shaker conveyor, conveyor belt or the like with a needle (4) separating device and pre-aligning device arranged upstream. In particular, different variants of a detection apparatus (20), of a utilization apparatus (21), of a feeding apparatus (14) as well as of a needle removal and needle placement apparatus (12, 13) may be combined with one another.

Moreover, an automatic needle placement machine (1) does not have to have all these above-mentioned apparatuses. For example, a magazine (37) for needles (4) that continue to be used may be eliminated so that the utilization apparatus (21) has only a discharge unit or the like for disposing of the needles (4) removed from the needle board (2). The discharge unit and the magazine (37) are present together in the exemplary embodiments being shown in order to offer a freedom of choice and to also make it possible to transfer needles (4) zone by zone to compensate wear or for other reasons.

Further, the features of the different exemplary embodiments described above and the possibility of varying them may be combined with one another and especially replaced as described.

While specific embodiments of the invention have been shown and described in detail to illustrate the application of the principles of the invention, it will be understood that the invention may be embodied otherwise without departing from such principles.

The invention claimed is:

1. An automatic needle placement machine for needles on needle boards of nonwoven needle machines, the automatic needle placement machine comprising:

a holding apparatus for the needle board;

a needle removal apparatus and a needle placement apparatus for removing and placing needles from and in receptacle openings of the needle board;

an automatic positioning apparatus linearly moving the holding, needle placement and needle removal apparatuses relative to one another and positioning same, wherein the holding apparatus has a multi-axis positioning apparatus; and a frame or a machine frame, wherein the needle placement and needle removal apparatus are arranged stationarily at the frame or at the machine frame.

2. An automatic needle placement machine in accordance with claim 1, wherein the needle placement and needle removal apparatus are arranged on opposite sides of the needle board and each have a tool with an advancing apparatus for advancing to the needle board.

3. An automatic needle placement machine in accordance with claim 1, wherein the needle placement and needle removal apparatus with their tools interact during the removal and/or during the placement of needles.

4. An automatic needle placement machine in accordance with claim 1, further comprising a detection apparatus for detecting needle quality.

5. An automatic needle placement machine in accordance with claim 4, wherein the detection apparatus comprises an optical inspection apparatus for the needle quality and/or a control apparatus for the needle stroke during the removal ejection of a needle.

6. An automatic needle placement machine in accordance with claim 1, further comprising a control with a program for needle identification and needle flow control.

7. An automatic needle placement machine in accordance with claim 2, wherein the needle removal tool of the needle removal apparatus is configured as an ejection tool comprising an ejection sleeve, and is adapted to the outer contour of the needle.

8. An automatic needle placement machine in accordance with claim 7, wherein the inner shape of the ejection sleeve is adapted to the outer contour of the needle such that the ejection sleeve receives the tip of the needle with a lateral clearance during the advancing and comes into contact with a shoulder of the needle, which shoulder is arranged behind the tip of the needle, with a sleeve edge of the ejection sleeve.

9. An automatic needle placement machine in accordance with claim 1, wherein the needle placement apparatus has a needle placement tool, which is configured to receive a separated needle, subsequently to align the separated needle and then to insert the separated needle exactly in a receptacle opening.

10. An automatic needle placement machine in accordance with claim 1, wherein the needle placement apparatus comprises a needle placement tool that has a receiving device for an individual needle, an aligning device for the rotary and/or axial alignment of the needle and an insertion and push-in device for the needle into the needle board.

11. An automatic needle placement machine in accordance with claim 10, wherein the insertion device and push-in device is configured as an extraction device for needles pushed at least partially out of the needle board.

12. An automatic needle placement machine in accordance with claim 10, wherein the aligning device has a rotary gripper for a crank of the needle with a controllable rotary drive and with a pushing drive.

13. An automatic needle placement machine in accordance with claim 1, wherein the needle placement apparatus has a monitoring apparatus.

14. An automatic needle placement machine in accordance with claim 1, wherein the needle placement apparatus has a separating device for needles with a lifting post driven in a controllable manner, whereby the lifting post interacts with a needle placement tool of the needle placement apparatus, which needle placement tool includes a receiving device, and positions a separated needle in the correct position for gripping.

15. An automatic needle placement machine in accordance with claim 1, further comprising a needle feeding apparatus with a magazine with a circulating conveyor, and one or more needle containers.

16. An automatic needle placement machine in accordance with claim 14, wherein the separating device has a sensor for detecting a separated needle at the lifting post.

17. An automatic needle placement machine for needles on needle boards of nonwoven needle machines, the automatic needle placement machine comprising:

a holding apparatus for the needle board;

a needle removal apparatus for removing needles from receptacle openings of the needle board;

a needle placement apparatus for placing needles in the receptacle openings of the needle board;

an automatic positioning apparatus linearly moving the holding apparatus, the needle placement apparatus and the needle removal apparatus relative to one another and positioning same; and a needle quality detection apparatus detecting needle quality, wherein:

the needle placement apparatus comprises a needle placement tool that has a receiving device for an individual needle, an aligning device for the rotary and/or axial alignment of the individual needle and an insertion and push-in device with a push in drive for insertion and push in of the individual needle into the needle board; and the aligning device has a rotary gripper for a crank of the needle with a controllable rotary drive.

18. An automatic needle placement machine in accordance with claim 17, wherein the needle quality detection apparatus comprises an optical inspection apparatus for the needle quality and/or a control apparatus for the needle stroke during the removal or the ejection of a needle.

19. An automatic needle placement machine for needles on needle boards of nonwoven needle machines, the automatic needle placement machine comprising:

a holding apparatus for the needle board;

a needle removal apparatus for removing needles from receptacle openings of the needle board;

a needle placement apparatus for placing needles in the receptacle openings of the needle board; and an automatic positioning apparatus linearly moving the holding apparatus, the needle placement apparatus and the needle removal apparatus relative to one another and positioning same, wherein:

the needle placement apparatus comprises a needle placement tool configured to receive a separated needle, subsequently to align the separated needle and then to insert the separated needle in a receptacle opening;

the needle placement tool comprises an aligning device for aligning the separated needle;

the aligning device has a rotary gripper for gripping a crank of the separated needle with a controllable rotary drive to set a rotational position of the separated needle; and the needle placement tool comprises a pushing drive.

20. An automatic needle placement machine for needles on needle boards of nonwoven needle machines, the automatic needle placement machine comprising:

a holding apparatus for the needle board;

a needle removal apparatus for removing needles from receptacle openings of the needle board;

a needle placement apparatus for placing needles in the receptacle openings of the needle board;

an automatic positioning apparatus linearly moving the holding apparatus, the needle placement apparatus and the needle removal apparatus relative to one another and positioning same; and a needle quality detection apparatus detecting needle quality, wherein:

the needle quality detection apparatus comprises a control apparatus for control of the needle stroke during the removal or ejection of a needle; and the needle removal apparatus has a removal tool with an advancing apparatus for advancing the removal tool to the needle board, the advancing apparatus being connected to the detection apparatus for checking the stroke of the needle.

* * * * *